US005091000A

United States Patent [19]

Ishii et al.

[11] Patent Number: 5,091,000

[45] Date of Patent: Feb. 25, 1992

[54] METHOD FOR CLEANING MOLTEN METAL AND APPARATUS THEREFOR

[75] Inventors: Toshio Ishii; Yutaka Okubo; Shuzo Fukuda; Yoshihiko Kawai; Shunichi Sugiyama; Yoshiteru Kikuchi; Hidetoshi Matsuno, all of Kawaski, Japan

[73] Assignee: NKK Corporation, Tokyo, Japan

[21] Appl. No.: 516,478

[22] Filed: Apr. 30, 1990

Related U.S. Application Data

[63] Continuation-in-part of Ser. No. 285,068, Dec. 15, 1988, abandoned, and a continuation-in-part of Ser. No. 481,776, Feb. 16, 1990, abandoned, which is a continuation of Ser. No. 295,808, Jan. 11, 1989, abandoned, and a continuation-in-part of Ser. No. 413,946, Sep. 28, 1989, abandoned.

[30] Foreign Application Priority Data

| | | | |
|---|---|---|---|
| Dec. 25, 1987 | [JP] | Japan | 62-326722 |
| Dec. 25, 1987 | [JP] | Japan | 62-326723 |
| Jan. 12, 1988 | [JP] | Japan | 63-3112 |
| Jan. 12, 1988 | [JP] | Japan | 63-3113 |
| Oct. 6, 1988 | [JP] | Japan | 63-9675 |
| Oct. 6, 1988 | [JP] | Japan | 63-250806 |
| Oct. 6, 1988 | [JP] | Japan | 63-250807 |
| Feb. 13, 1989 | [JP] | Japan | 1-031105 |

[51] Int. Cl.[5] ..... C21C 7/02

[52] U.S. Cl. ..... 75/508; 75/512; 75/708; 266/210; 266/287

[58] Field of Search ..... 75/508, 512, 708; 266/210, 287

[56] References Cited

U.S. PATENT DOCUMENTS

| | | | |
|---|---|---|---|
| 3,025,155 | 11/1958 | Lee et al. | 75/68 R |
| 3,060,015 | 10/1962 | Spolders et al. | 75/60 |
| 3,201,226 | 8/1965 | Spolders | 75/512 |
| 3,291,596 | 12/1966 | Verge et al. | 75/49 |
| 3,295,960 | 1/1967 | Parlee et al. | 75/93 R |
| 3,484,232 | 12/1969 | Karinthi et al. | 75/45 |
| 3,547,622 | 12/1970 | Hutchinson | 75/10 R |
| 3,640,702 | 2/1972 | Karinthi | 75/512 |
| 3,737,302 | 6/1973 | Pomey | 75/10 R |
| 3,743,500 | 7/1973 | Foulard et al. | 75/93 R |
| 3,798,025 | 3/1974 | Ramachandran | 75/511 |
| 4,071,356 | 1/1978 | Yamamoto | 75/512 |
| 4,298,376 | 11/1981 | Narita et al. | 75/49 |
| 4,636,249 | 1/1987 | Laycock | 75/546 |
| 4,647,306 | 3/1987 | Abratis et al. | 75/49 |
| 4,780,134 | 10/1988 | Finkl et al. | 75/10.39 |

*Primary Examiner*—Peter D. Rosenberg

*Attorney, Agent, or Firm*—Frishauf, Holtz, Goodman & Woodward

[57] ABSTRACT

Molten metal is put under pressure of up to 10 atmospheres in a covered ladle and a gas soluble in the metal is bubbled through the melt. Some gas goes into solution, while the remainder rises in bubbles and brings inclusions suspended in the molten metal up to the surface. Then the pressure is lowered, after which gas comes out of the solution in fine bubbles which also bring impurity inclusions up to the surface. In another method molten steel is refined at pressures not exceeding atmospheric pressure in a covered ladle equipped for evacuation and equipped for bubbling gas through the molten steel bath. Bubbling followed by pressure reduction can then be performed to form two stages of cleaning. Heat may be added for compensating the cooling effect of gas expansion. Instead of a closed ladle, an open ladle may be used, into which there can be dipped a chamber fitted for evacuation and having two large tubes at opposite sides of the chamber extending downwards to orifices that may be lowered into the molten metal in the ladle. The melt is then drawn up into the chamber by atmospheric pressure as the chamber is evacuated. Then bubbling may be performed in one connecting tube by injection of gas from the bottom of the ladle, or at a mid-level of the tube, to produce circulation of the molten metal up into the chamber and down through the other tube.

59 Claims, 14 Drawing Sheets

METHOD FOR CLEANING MOLTEN METAL AND APPARATUS THEREFOR

This application is a continuation-in-part of each of the following applications:

U.S. Ser. No. 07/285,068; filed Dec. 15, 1988 by Toshio ISHII; Yutaka OKUBO; and Shuzo FUKUDA; now abandoned U.S. Ser. No. 07/481,776; filed Feb. 16, 1990 by Toshio ISHII; Yutaka OKUBO; Shuzo FUKUDA and Yoshihiko KAWAI, now abandoned which is a continuation of Ser. No. 07/295,808 filed Jan. 11, 1989 and now abandoned; and U.S. Ser. No. 07/413,946; filed Sept. 28, 1989 by Toshio ISHII; Shunichi SUGIYAMA; Yoshiteru KIKUCHI; and Hidetoshi MATSUNO, now abandoned.

all of the above said applicants being assignors to the same assignee.

BACKGROUND OF THE INVENTION

1. Field of the Invention

The present invention relates to a method for cleaning molten metal by removing inclusions suspended in molten metal and an apparatus therefor. In one aspect it involves making nonmetallic inclusions rise to the surface of the molten metal for facilitating their removal. In another aspect, the invention involves a method for refining molten steel in a vacuum, in particular a method of degassing steel.

2. Description of the Prior Art

There have been proposed various methods for decreasing or removing inclusions (for example alumina inclusions) suspended in molten metal since those inclusions can be a cause of defects and lower the quality of a product. Four proposed methods are described below:

(a) A first method, wherein inclusions in molten metal are trapped by gas bubbles produced by bubbling inert gas in molten metal at atmospheric pressure from the bottom of a vessel having molten metal therein. The inclusions are removed from the molten metal after the inclusions have risen to the surface of the molten metal.

(b) A second method, wherein inclusions in molten metal are removed by a filter made from calcium oxide which is put in a flow of the molten metal.

(c) A third method, wherein inclusions in molten metal are removed by throwing a solid such as calcium oxide capable of adsorbing the inclusions into the molten metal.

(d) A fourth method, wherein inclusions in molten metal are removed by having the inclusions rise to the surface of the molten metal or sink because of differences in densities of the inclusions and the molten metal.

However, in case of having an object of manufacturing quality material, a total amount of oxygen in molten metal needs to be limited to 15 ppm or less. When molten metal is cleaned by use of said methods, there can occur the following problems:

In the first method, a zone of the bubbling only spreads upwardly from a gas blowing-in inlet positioned at the bottom of a vessel. Moreover, there is a problem that it is difficult to bubble the molten metal from the whole vessel. When the bubbles produced by bubbling are large, the molten metal flows, bypassing the bubbles, during the bubbles' rising to the surface of the molten metal. In this case, micro-inclusions in the molten metal are hard to be trapped by the bubbles since the micro-inclusions also move together with the flow of the molten metal, bypassing the bubbles.

In the second method, when a filter capable of removing micro-inclusions is used, the filter often is choked and unable to be used soon after it has begun to be used.

In the third method, when the effectiveness of removing inclusions in molten metal by use of a solid such as calcium oxide decreases, there occurs a necessity for withdrawing the solid out of the molten metal. In this case, there is a problem that the withdrawal of the solid requires troublesome work and, moreover, the efficiency of the withdrawal of the solid is low.

In the fourth method, due to small particles of the micro-inclusions, the rising or the sinking of the micro-inclusions takes a lot of time. This leads to a decrease of the efficiency of removing the micro-inclusions.

A large amount of gas components is contained in molten steel produced in a steel-making furnace such as a converter and the like which smelts and refines steel. To remove the gas components, there are carried out various vacuum processing methods wherein molten steel is degassed in a vacuum. Out of those methods, for example, a RH vacuum degassing method is known. In this RH vacuum degassing method, a ladle is filled up with molten steel to be processed. Two immersion nozzles arranged at the lower portion of a vacuum vessel are immersed in the molten steel from the upper side of the ladle. Inert gas is blown from the middle of one immersion nozzle to have the molten steel in the ladle circulated through the immersion nozzles inside the vacuum vessel. In this way, the molten steel is degassed in the vacuum vessel.

Requirements for components of steel for a special use, however, are more severe than those of molten steel processed with the RH vacuum degassing method. Therefore, it is necessary to use other methods so as to process molten steel for a special use. To remove alumina inclusions in molten steel, for example, the total amount of oxygen in the molten steel needs to be decreased. The total amount of oxygen in the molten steel can barely be decreased to approximately 10 ppm by use of the RH vacuum degassing method. Therefore, the RH vacuum degassing method cannot be applied to steel which requires a total amount of oxygen of less than 10 ppm.

SUMMARY OF THE INVENTION

It is an object of the present invention to provide a method for cleaning molten metal, wherein not only inclusions of an ordinary size, but also micro-inclusions can be removed from molten metal.

The present invention provides a method for cleaning molten metal, which comprises:

a bubbling process, wherein a gas soluble in molten metal is bubbled into said molten metal under increased pressure, inclusions suspended in said molten metal are trapped by the gas bubbles produced by bubbling and rise to the surface, and some of said gas is dissolved in said molten metal;

a pressure reduction process, wherein fine gas bubbles are produced in the molten metal by reducing a pressure on the molten metal in which gas is dissolved, and the inclusions suspended in the molten metal are trapped by the fine gas bubbles produced by reduction of the pressure which rise to the surface; and an inclusions removing process, wherein inclusions which have risen to the surface of the molten metal are removed.

Further, the present invention provides an apparatus for cleaning molten metal, which comprises:

a first vessel which has an inlet for charging molten metal at the top end thereof and an outlet for discharging molten metal at the bottom thereof and in which the molten metal is pressurized by its static pressure;

a second vessel which has an inflow port for pressurized molten metal at the bottom thereof and an outflow port for the pressurized molten metal and in which the pressurized molten metal goes upwardly and the pressure on the molten metal is reduced;

a communicating tube connecting the first vessel to the second vessel; and a first bubbling device positioned at the bottom of the first vessel for bubbling the gas soluble in molten metal into said molten metal.

In another metal-cleaning method of the invention molten metal under elevated pressure is bubbled by a gas soluble in the moltem metal, inclusions being suspended in the molten metal are trapped by gas bubbles produced by bubbling and by fine gas bubbles produced by reducing the pressure on pressurized molten metal. After the inclusions have risen to the surface of the molten metal, said inclusions are removed. Ordinary inclusions are trapped by first bubbling. Said trapped inclusions rise to the surface of the molten steel. On the other hand, since pressurized molten metal is bubbled, a large amount of bubbling gas dissolves in the molten metal. Thereafter, gas dissolved in the molten metal appears as fine gas bubbles from the entire zone of the molten metal by rapidly reducing a pressure inside a vessel. During the bubbling, the fine inclusions are trapped by the bubbles and rise to the surface of the molten metal with the bubbles.

The above-mentioned method is very effective in removal of the inclusions in the molten metal. However, since the molten metal is pressurized at the initial stage of a processing step, some portion of the bubbling gas having once dissolved in the molten metal appears as fine gas bubbles during the reduction of the pressure on the molten metal, but the rest of the gas remains dissolved in the molten metal. Accordingly, one more processing step for degassing the molten metal is required after the above-mentioned processing of the gas has been carried out. Therefore, there have been problems in that degassing capacity and the number of processing steps had to be increased. In addition, a cost for equipment increased because of the use of a pressure vessel.

The present invention also provides a method for cleaning molten metal in which no pressure vessel is used, and degassing of the molten metal is carried out in the same vessel as that of bubbling method comprising the steps of:

keeping a pressure inside a vessel having molten metal therein at a pressure of Ps of atmospheric pressure or less;

bubbling the molten metal in the vessel by gas soluble in the molten metal, a portion of said gas dissolving in the molten metal and the rest of said gas converting to gas bubbles; and reducing rapidly the pressure in the vessel to pressure $P_E$, fine gas bubbles being produced in the molten metal in the vessel, nonmetallic inclusions being trapped by said fine gas bubbles and by gas bubbles produced by bubbling and rising to the surface of the molten metal, and gas dissolved in the molten metal being removed.

In another method of the present invention, the molten metal is not processed under elevated pressure as in the prior art method. The molten metal is processed under reduced pressure after the molten metal has been bubbled by blowing gas soluble in the molten metal at atmospheric pressure or less. Particularly, in this processing under reduced pressure, not only the fine gas bubbles are simply produced, but also said bubbling gas remaining dissolved in the molten metal is removed together with the fine gas bubbles.

The present invention also provides a method for refining molten steel in a vacuum comprising: an immersion process, wherein two immersion tubes arranged at the lower portion of a vacuum vessel are immersed in molten steel in a ladle, said two immersion nozzles are a rising tube and a sinking tube; a first degassing process, wherein said molten steel is degassed by keeping said vacuum vessel evacuated, having said molten steel circulated between said ladle and said vacuum vessel being kept evacuated by injecting gases containing at least an inert gas from the middle of said rising tube; and blowing in said molten steel gases containing at least gas soluble in said molten steel.

Finally, the invention also provides a further method comprising: an immersion process, wherein two immersion tubes are partially immersed in molten steel in a ladle, a rising tube and a sinking tube; a dissolving process, wherein gases are dissolved in said molten steel by blowing in said molten steel gases containing at least gas soluble in said molten steel from a gas blow-in opening arranged in said ladle; a first degassing process, wherein said molten steel is degassed by keeping said vacuum vessel evacuated, having said molten steel circulated between said ladle and said vacuum vessel by injecting gases containing at least an inert gas from the middle of said rising tube in said molten steel, and blowing gases containing at least gas soluble in said molten steel from a gas blow-in opening arranged in said ladle; and a second degassing process, wherein said molten steel is degassed by keeping said vacuum vessel evacuated, stopping a gas blowing-in from said gas blow-in opening arranged in said ladle and having said molten steel circulated between said ladle and said vacuum vessel being kept evacuated by injecting gases containing at least an inert gas from the middle of said rising tube in said molten steel.

The above aspects of the present invention will now become apparent from the detailed description which follows, taken in connection with the drawings.

DESCRIPTION OF THE PREFERRED EMBODIMENT

Preferred Embodiment-1

The gas soluble in molten metal is bubbled in said molten metal under increased pressure. Inclusions of large particle size in the molten metal are trapped by the bubbles produced by a first bubbling, go upwardly to the surface of the molten metal and are removed. Since the molten metal under increased pressure is bubbled, a large amount of gas is uniformly dissolved in the molten metal by stirring the molten metal by means of bubbling. Thereafter, the gas dissolved in the molten metal is converted to fine gas bubbles while the pressure is rapidly reduced. The fine gas bubbles are produced from the whole area of the molten metal. Micro-inclusions are trapped by the fine gas bubbles, rise to the surface of the molten metal and are removed.

Nitrogen gas and hydrogen gas are preferred as the gas soluble in molten metal. Hydrogen gas is more desirable if the later removal of the gas, which remains in the molten metal, is taken into consideration. A pressure of from 1 to 10 atm is preferred to the atmospheric pressure for applying pressure on the molten metal. When the molten metal is pressurized at a pressure of less than 1 atm, it is less effective to pressurize the molten metal. When the molten metal is pressurized at a pressure of more than 10 atm, the apparatus becomes too expensive. The pressure on the molten metal is desired to be reduced in several stages from a pressure applied to the molten metal because fine bubbles are produced at every stage of the pressure reduction. For example, the pressure on the molten metal is reduced in such a manner as: 10 atm→7 atm→4 atm→1 atm. The method of the present invention as mentioned above can be carried out by means of a batch process wherein a pressure vessel is used or a continuous process wherein a U-shaped vessel is used.

Figure 1:
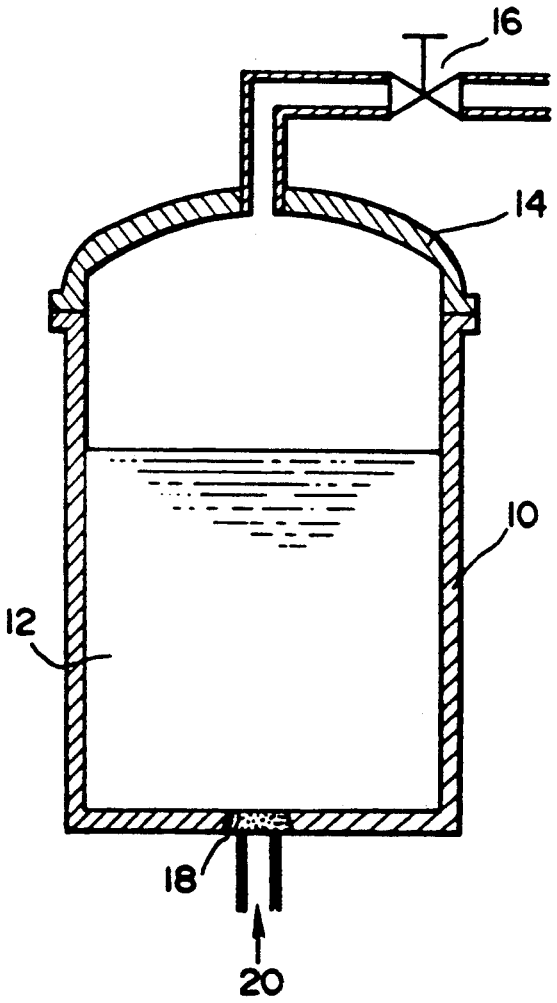
FIG. 1 is a cross sectional view showing schematically an apparatus for cleaning molten metal by means of a batch process of the present invention.

FIG. 1 is a cross sectional view showing schematically an apparatus for cleaning molten metal by means of a batch process. A method for cleaning molten metal by means of the batch process will now be explained with specific reference to FIG. 1. Firstly, molten metal is poured into pressure vessel 10. Thereafter, pressure vessel 10 is closed with cover 14 and molten metal 12 is pressurized by controlling pressure valve 16 mounted on a duct connected to cover 14. Gas 20 soluble in the molten metal is blown in the molten metal under pressure from bubbling device 18 positioned at the bottom of vessel 10. After a bubbling has finished, a pressure applied to molten metal 12 is rapidly reduced by controlling pressure valve 16. Finally, the inclusions which have risen to the surface of the molten metal are removed.

Figure 2:
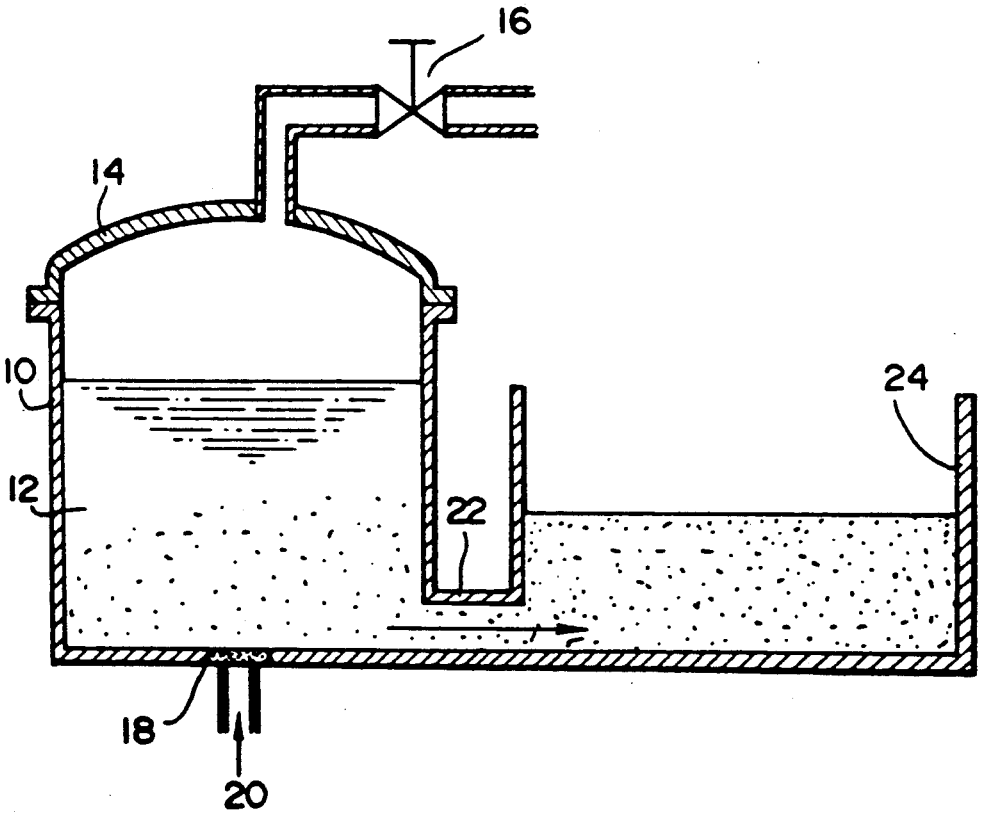
FIG. 2 is a cross sectional view illustrating another apparatus for cleaning molten metal by means of a batch process of the present invention.

FIG. 2 is a cross sectional view illustrating another apparatus for cleaning molten metal by means of a batch process. With the use of this apparatus, a pressure applied to molten metal 12 can be rapidly reduced by transferring the molten metal being kept under pressure to vessel 24 opened for the air through communicating tube 22.

Figure 3:
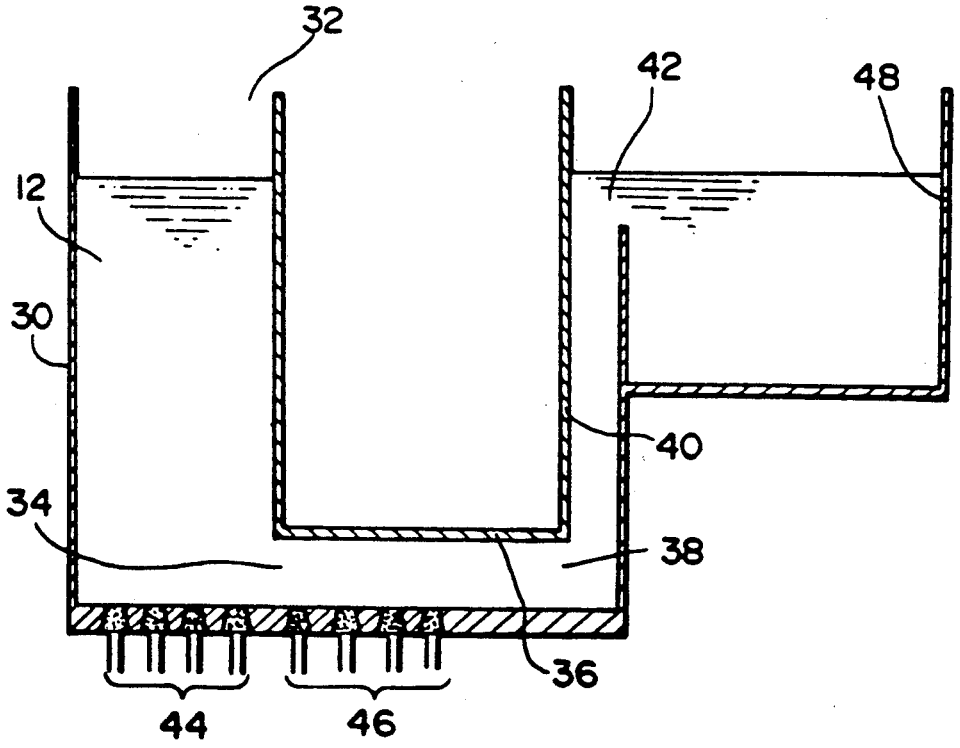
FIG. 3 is a cross sectional view showing schematically an apparatus for continuously cleaning molten metal with the use of a U-shaped vessel of the present invention.

FIG. 3 is a cross sectional view showing schematically a method for continuously cleaning molten metal with the use of a U-shaped vessel. Molten metal is continuously charged into a vessel through inlet 32 positioned at the top end of first vessel 30. Molten metal 12 goes down inside first vessel 30 and is gradually pressurized by its static pressure. Molten metal 12 which has reached the bottom of vessel 30 is sufficiently pressurized by its static pressure. There is output port 34 at the bottom of vessel 30. The molten metal flows to communicating tube 36 through outflow port 34. The molten metal is bubbled by bubbling device 44 positioned at the bottom of first vessel 30 and by bubbling device 46 positioned at the bottom of communicating tube 36 connected to the first vessel. The molten metal, which has passed through communicating tube 36, enters second vessel 40 through inflow port 38 positioned at the bottom of second vessel 40. There is output port 42 for discharging molten metal at the top end of second vessel 40. The molten metal rises toward outlet 42 for discharging molten metal inside second vessel 40. With the rise of the molten metal, a pressure on the molten metal is rapidly reduced, and gas dissolved in the molten metal appears in the molten metal as fine gas bubbles. The fine gas bubbles rise to the surface of the molten metal, trapping inclusions in the molten metal. The molten metal, which has gone out of outlet 42 for discharging molten metal from second vessel 40, enters receptor 48. The inclusions floating on the surface of the molten metal inside receptor 48 are continuously removed.

Preferred Embodiment-2

A method of Preferred Embodiment-1 is highly effective in removing inclusions in molten metal. It was understood that, in order to further decrease the inclusions in the molten metal, it is good to decrease the flutter of the molten metal surface which is produced when the gas bubbles produced by bubbling and the innumerable bubbles produced by a pressure reduction rise to the surface of the molten metal and to take measures so that the inclusions which had risen to the surface of the molten metal could not mix again with the molten metal. Therefore, in a method of Preferred Embodiment-2, static magnetic field is applied to the surface of the molten metal when the inclusions trapped by the bubbles produced by bubbling and by innumerable bubbles produced by the pressure reduction rise to the surface of the molten metal.

Figure 5:
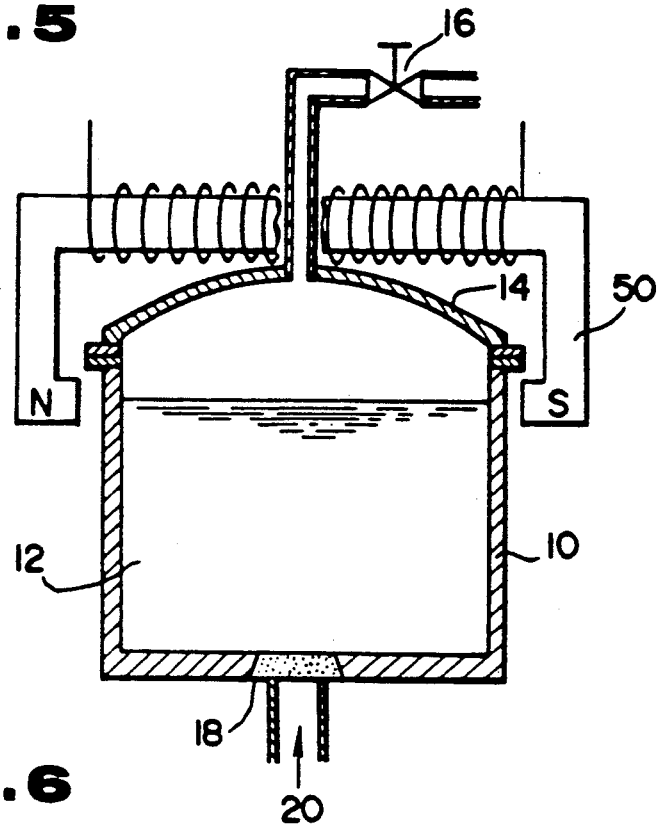
FIG. 5 is a cross sectional view showing schematically an outline of an apparatus used for a method of Preferred Embodiment-2.

FIG. 5 is a cross sectional view showing schematically an outline of an apparatus used for a method of Preferred Embodiment-2. When a static magnetic field is applied to molten metal in a direction at right angles to the flow of the molten metal, a braking force against the flow of the molten metal takes place. The flutter of the molten metal surface just corresponds to an up-and-down flow of the molten metal bath. A force suppressing the up-and-down flow of the molten metal is produced by applying the static magnetic field to the surface of the molten metal with the use of electromagnet 50. Thereby, the width of the flutter is decreased, and this can prevent the occurrence of waves on the surface of the molten metal. Force F suppressing the flutter of the molten metal surface is represented by the following formula:

$$F=\sigma\times B^2\times V$$

$\sigma$: electric conductivity of molten metal bath
B: magnetic induction
V: velocity of up-and-down movement of molten metal surface The magnetic induction of the static magnetic field is preferred to be of from 1000 to 5000 gausses. When said magnetic induction is less than 1000 gausses, a force suppressing the flutter of the molten metal surface is small. When the magnetic induction exceeds 5000 gausses, there is no change in the effectiveness of the force suppressing the flutter of the molten metal surface.

Preferred Embodiment-3

The present inventors conducted various tests for the purpose of increasing the processing capability of the apparatus and understood that, when time for leaving the molten metal as it was shortened, micro-inclusions in the molten metal were not removed as expected. In consequence, it was thought to further increase the efficiency in the removal of ordinary inclusions by the bubbling carried out before the pressure reduction process. As a result of the tests conducted later, it was understood that the efficiency in the removal of inclusions by bubbling was increased by applying a low frequency electromagnetic force to molten metal during bubbling and actively stirring the molten metal. It is thought that the reason why the efficiency in the removal of the inclusions is increased is that the inclusions in the molten metal increasingly strike against one another by stirring and the inclusions having grown comparatively larger rise to the surface of the molten metal during bubbling. In addition, since the amount of bubbling gas dissolved in the molten metal was expected to be increased by stirring, the amount of fine gas bubbles was increased by the pressure reduction and the efficiency in the removal of the micro-inclusions was expected to be increased.

On the other hand, the temperature of the molten metal was decreased by the bubbling. In this connection, the amount of the bubbling gas dissolved in the molten metal was decreased. Fluidity of the molten metal also was decreased. In consequence, the effectiveness of the stirring by the bubbling decreased.

In order to overcome those difficulties, the molten metal could be actively heated by heat energy produced by induced current generated by applying an electromagnetic force to the molten metal during bubbling.

The reason why it was only during bubbling when the electromagnetic force was applied to the molten metal was consideration so that the inclusions having once risen to the surface of the molten metal after the pressure reduction could not be mixed again with the molten metal by an electromagnetic stirring.

EXAMPLE-1

The cleaning of molten metal in Preferred Embodiment-1 was carried out by means of a batch process with the use of a pressure vessel of 2 m in inside diameter and 3 m in height as shown in FIG. 1.

Firstly, 50 tons of molten steel were poured into pressure vessel 10. Subsequently, pressure vessel 10 was closed with cover 14 and sealed. Atmospheric gas inside pressure vessel 10 was substituted for argon gas. Thereafter, a mixed gas consisting of 70% Ar gas and $H_2$ gas was bubbled in the molten steel for 20 minutes at a rate of 200 l/min from bubbling device 18 positioned at the bottom of pressure vessel 10. A gas pressure inside pressure vessel was adjusted to 3 atm by means of pressure valve 16. After the bubbling had finished, the gas pressure inside pressure vessel 10 was reduced to the atmospheric pressure by means of pressure valve 16. The molten steel was left as it was for 20 minutes until the gas bubbles produced by the pressure reduction rose to the surface of the molten steel. Finally, the molten steel was transferred to the next process.

The cleaning of molten steel was carried out as control-1 by use of a prior art gas bubbling method. That is, argon gas was blown in 50 tons of the molten steel under the atmospheric pressure at a rate of 400 l/min or 40 minutes.

Figure 4:
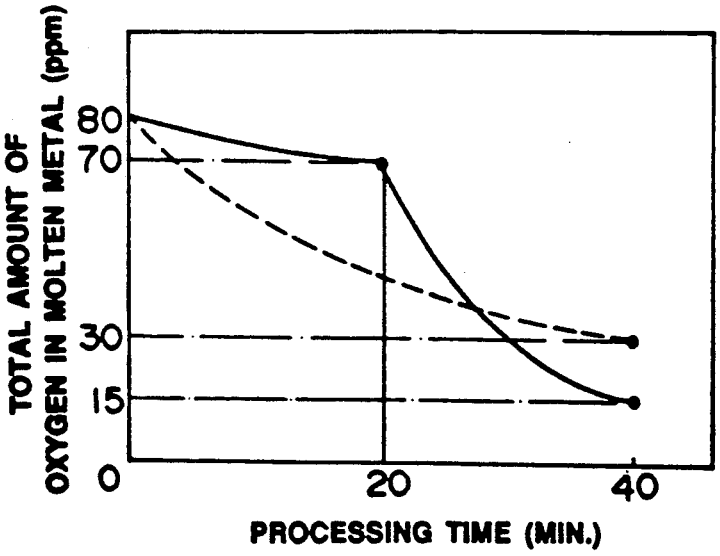
FIG. 4 is a graphic representation of a change in time of a total amount of oxygen in molten metal during processing the molten metal in example-1 and control-1.

FIG. 4 is a graphic representation of a change in time of a total amount of oxygen in the molten steel during processing the molten steel in Example-1 and Control-1. The change of the total amount of oxygen in the molten steel in Example-1 is shown with a solid line and that in Control-1 with a dashed line. The total amount of oxygen before processing the molten steel was 80 ppm, but the amount of oxygen was decreased to 15 ppm in Example-1 while the amount of oxygen was decreased only to 30 ppm in Control-1. It was understood that the case of Example-1 of the present invention was superior to the case of Control-1 in the effectiveness of cleaning the molten steel. A total amount of bubbling gas was 16000 l in Control-1. A total amount of the bubbling gas was 4000 l (2800 l of Ar gas and 1200 l of $H_2$ gas) in Example-1. In Example-1 of the present invention, the amount of gas used for the bubbling could be decreased and this could lead to a decrease of running cost.

EXAMPLE-2

A method of the present invention in Preferred Embodiment-1 was carried out by means of a continuous process with the use of a U-shaped vessel as shown in FIG. 3. The dimensions of each portion of the vessel were as follows:

| | |
|---|---|
| Height of a first vessel: | 4 m |
| Inside diameter of the first vessel: | 1 m |
| Length of a communicating tube: | 2 m |
| Inside diameter of the communicating tube: | 30 cm |
| Bubbling device (zones of 44 and 46) | 2 m |
| Diameter of a second vessel: | 10 cm |

Molten steel was continuously charged into the vessel from inlet 32 positioned at the top end of first vessel 30 at a rate of 250 t/hr. A mixed gas consisting of 60% Ar gas and 40% $H_2$ gas was bubbled in the molten steel from bubbling devices 44 and 46 at a rate of 200 l/min. In consequence, the total amount of oxygen, which was 80 ppm before the molten steel was processed, was decreased to 12 ppm in the molten steel at the bottom of receptor 48. It was understood that the effectiveness in oxidation of the molten steel became higher.

EXAMPLE-3

The cleaning of molten metal in Preferred Embodiment-2 was carried out by means of a batch process with the use of a pressure vessel of 2 m in inside diameter and 3 m in height as shown in FIG. 5.

Figure 6:
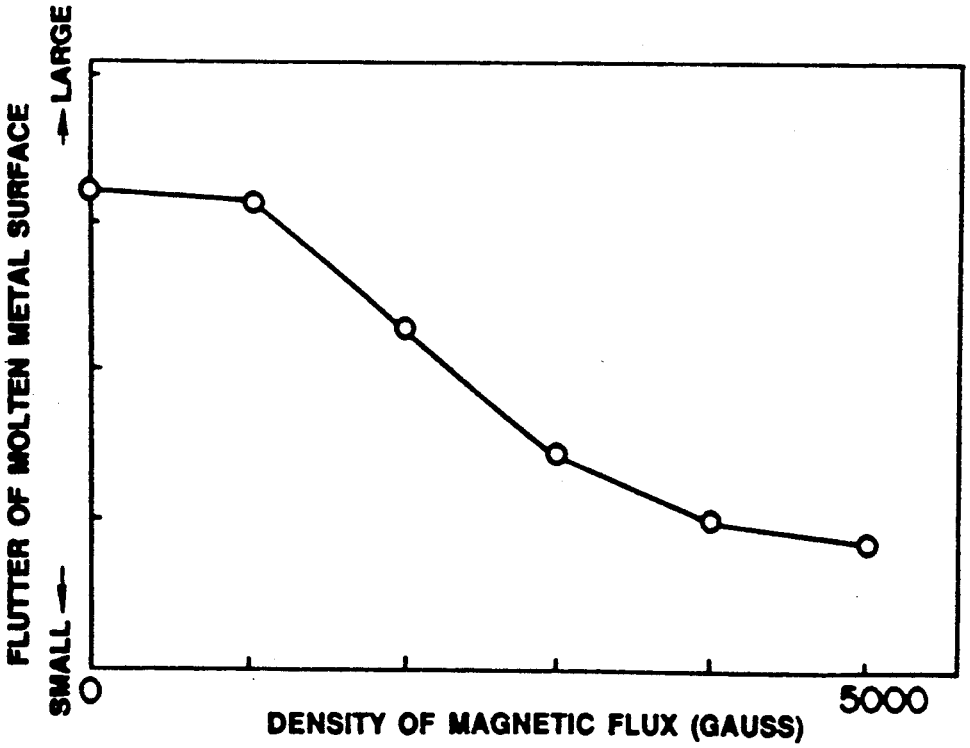
FIG. 6 is a graphic representation of the change of the flutter of the surface of the molten metal, which was produced by applying static magnetic field to the molten metal, relative to magnetic flux density of static magnetic field in the abscissa.

Molten metal was poured into pressure vessel 10 so that the level of the molten steel could rise to 2 m in height in pressure vessel 10. The atmosphere inside pressure vessel 10 was substituted for argon gas. Thereafter, a mixed gas consisting of 70% Ar gas and 30% $H_2$ gas was blown in the molten steel from bubbling device 18 positioned at the bottom of pressure vessel 10 at a rate of 300 l/min to bubble the molten steel. A gas pressure inside pressure vessel 10 was increased to 10 atm during bubbling. Subsequently, a static magnetic field was applied to the surface of the molten steel bath by use of electromagnet 50. Thereby, a force suppressing a flutter of the molten steel surface was produced. Thereafter, the bubbling was stopped. The gas pressure inside pressure vessel 10 was rapidly reduced by means of pressure valve 16, and fine gas bubbles were produced from the whole area of the molten steel. In Example-3, a static magnetic field was applied to the surface of the molten steel even when the gas pressure was reduced. FIG. 6 is a graphic representation of the change of the flutter of the molten steel-surface, which was produced by applying a static magnet field to the molten steel, relative to magnetic flux density of the static magnetic field in the abscissa. In this schematic representation when the magnetic flux was over 1000 gausses, there appeared an effect of suppressing a flutter on the surface of the molten steel, and, when the magnetic flux exceeded 5000 gausses, there was no change in the effectiveness of the force suppressing the flutter of the molten steel.

EXAMPLE-4

Figure 7:
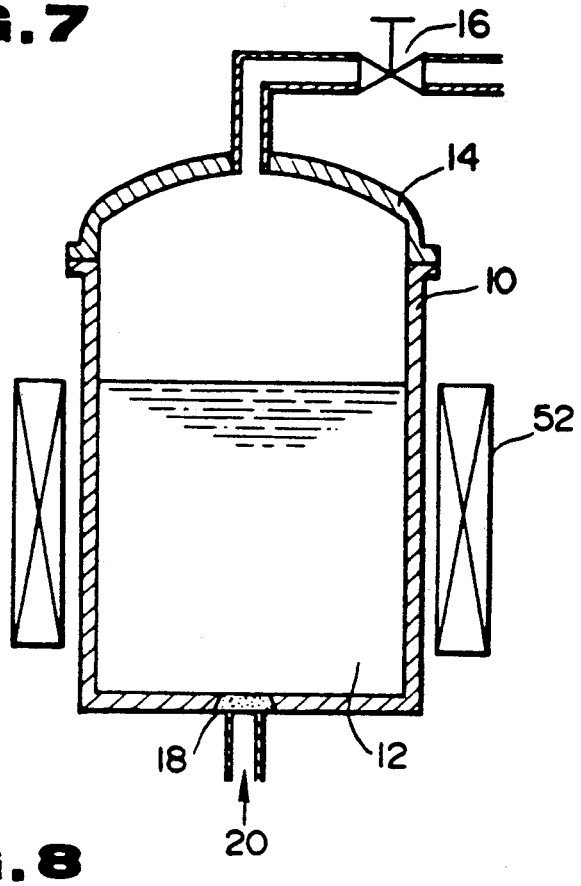
FIG. 7 is a cross sectional view illustrating an apparatus used for a method in Preferred Embodiment 3.

The cleaning of molten metal in Preferred Embodiment was carried out by means of a batch process with the use of a pressure vessel of 2 m in inside diameter and 3 m in height as shown in FIG. 7.

Firstly, 50 tons of molten steel were poured into pressure vessel 10. Subsequently, pressure vessel 10 was closed with cover 14 and sealed. Atmospheric gas inside pressure vessel 10 was substituted for argon gas. Thereafter, mixed gas consisting of 70% Ar gas and 30% $H_2$ gas was blown in the molten steel from bubbling device 18 positioned at the bottom of pressure vessel 10 at a rate of 200 l/min and the molten steel was bubbled for 20 minutes. A gas pressure inside pressure vessel 10 was adjusted to 3 atm by means of pressure valve 16. An electromagnetic force was applied to the molten steel with the use of electromagnetic coils 52 arranged around pressure vessel 10 during bubbling, and the molten steel was subjected to electromagnetic stirring. Subsequently, the gas bubbling and the electromagnetic stirring were stopped, and the gas pressure inside pressure vessel 10 was reduced to the atmospheric pressure by means of pressure valve 16. The molten steel was left as it was until the gas bubbles produced by the pressure reduction rose to the surface of the molten steel.

Figure 8:
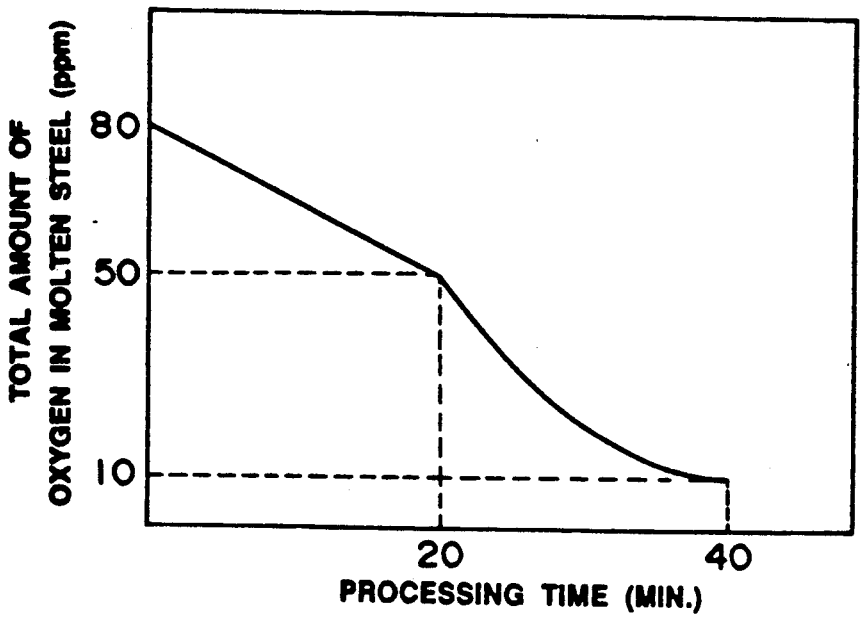
FIG. 8 is a graphic representation of a change in time of a total amount of oxygen in molten metal during processing the molten metal in Example-4 of the present invention.

FIG. 8 is a graphic representation of a change in time of a total amount of oxygen in the molten steel during processing the molten steel in Example-4. In Example-4, the total amount of oxygen in the molten steel was already fairly decreased by an electromagnetic stirring during bubbling a mixed gas. It is thought that inclusions in the molten steel increasingly stroke against one another, that the inclusions having had grown comparatively larger rose to the surface of the molten steel, and that the total amount of oxygen in the molten steel was decreased. Moreover, the total amount of oxygen after the completion of all the processes also was decreased to 10 ppm, which were less than in Example-1. The decrease of the total amount of oxygen can be explained by the following two reasons: Firstly, comparatively small inclusions in the molten steel grew larger by striking against one another, being stirred during bubbling, and were easily trapped by gas bubbles; and, subsequently, the amount of gas dissolved in the molten steel became large and this increased the amount of fine gas bubbles produced during a pressure reduction. Accordingly, it is necessary to take a little bit more time to leave the molten steel as it is after the pressure reduction so as to make the total amount of oxygen in the molten steel processed in Example-1 equal to the total amount of oxygen in the molten steel processed in Example-4.

EXAMPLE-5

Figure 9:
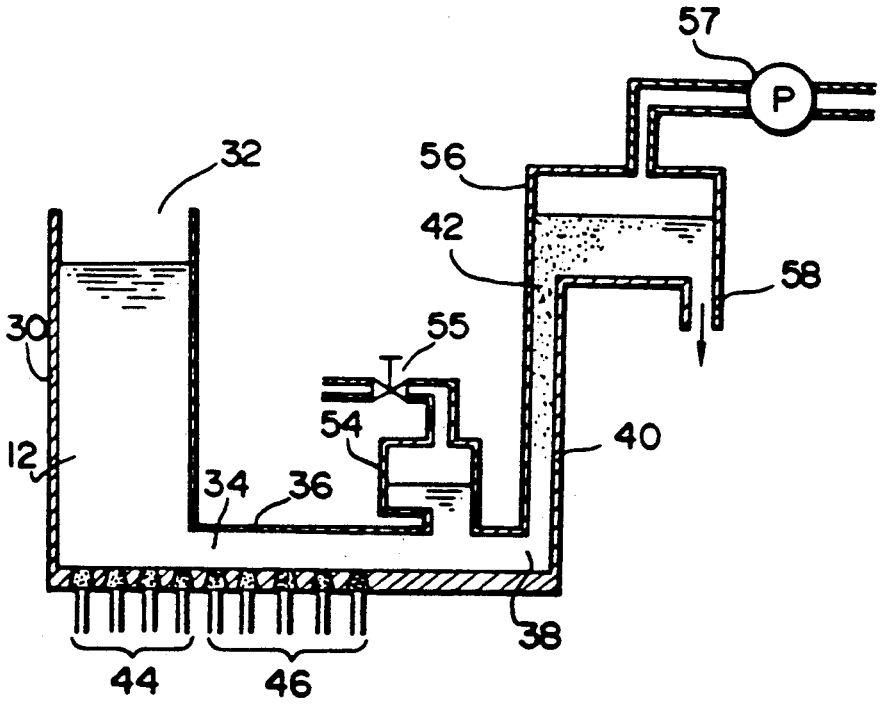
FIG. 9 is a cross sectional view illustrating an apparatus for continuously cleaning molten metal which is used in Example-5.

Preferred Embodiment of the apparatus for cleaning molten metal of the present invention will now be explained with specific reference to FIG. 9. The apparatus for cleaning molten metal was composed of first vessel 30, communicating tube 36, second vessel 40 and vacuum storage vessel 56. First vessel was of 1 m in inside diameter and of 5 m in height. An opening at the top end of said first vessel was inlet 32 for charging molten metal. Outlet 34 for discharging moltent metal was arranged at the bottom of first vessel 30. The molten metal flow through outlet 34 to communicating tube 36. Communicating tube 36 was of 50 cm in inside diameter and of 6 m in length. First bubbling device 44 was positioned at the bottom of first vessel 30 and second bubbling device 46 at the bottom of communicating tube 36 connected to first vessel 30 so that the molten metal could be bubbled from said bubbling devices 44 and 46. Gas storage chamber 54 was arranged at the position located a little bit beyond bubbling device 46 positioned at the bottom of communicating tube 36. Measures were taken by discharging a part of the bubbled gas to storage chamber 54 so that the gas bubbles rising to the surface of the molten metal inside second vessel 40 which would be described later could not grow too large. The gas inside gas storage chamber 54 was discharged by means of pressure valve 55. The molten metal, which had passed through communicating tube 36, entered second vessel 40 through inflow port 38 positioned at the bottom of second vessel 40. Second vessel 40 was of 30 cm in inside diameter and of 5 m in height. The inside diameter of second vessel 40 was made small so that the pressure on the molten metal could be rapidly reduced by having the molten metal more rapidly flow inside second vessel 40. Outlet 42 for discharging molten metal was positioned at the top end of second vessel 40. Vacuum storage vessel 56 of 2 m in inside diameter connected to outlet 42 for discharging molten metal was arranged, and the molten metal stored in vacuum storage vessel 56 was degassed. Vacuum storage vessel 56 was arranged for the purpose of removing the gas bubbles produced by the bubbling and the pressure reduction, removing the inclusions rising to the surface of the molten metal, being trapped by the gas bubbles and discharging the gas dissolved in the molten metal even unde atmospheric pressure. Gas in vacuum storage vessel 56 was exhausted by means of vacuum pump 57. Tube 58 of 30 cm in inside diameter for bringing out the molten metal having been cleaned to the next process was connected to the bottom of vacuum storage vessel 56. In said apparatus, molten metal is continuously charged into a vessel through inlet 32 and the molten metal taken out through outlet 42 to vacuum storage vessel 56 can be the molten metal very well cleaned by bubbling the gas soluble in the molten metal from bubbling devices 44 and 46. That is, molten metal 12 discharged through inlet 32 is gradually pressurized by its static pressure, going down inside first vessel 30. A large amount of the gas bubbled from bubbling devices 44 and 46 dissolves in the molten metal.

Simultaneously, inclusions of ordinary size are trapped by bubbling gas and flow through communicating tube 36. A part of the bubbling gas enters gas storage chamber 54 and is taken out of gas storage chamber 54 utwardly by means of pressure valve 55. The molten metal having passed through communicating tube 36 enters second vessel 40 through inflow port 38 positioned at the bottom of second vessel 40. The pressure on the molten metal is rapidly reduced when the molten metal goes upwardly inside second vessel 40. Then, the gas dissolved in the molten metal appears as fine gas bubbles. Those fine gas bubbles rise to the surface of the molten steel, trapping inclusions in the molten metal. The molten metal enters vacuum storage chamber 56 through outlet 42. In vacuum storage vessel 56, the inclusions are trapped by the gas bubbles and the fine gas bubbles produced by the bubbling and the pressure reduction respectively and rise to the surface of the molten metal. To remove the gas soluble in the molten metal, the molten metal is degassed inside vacuum storage vessel 56. The molten metal cleaned by removing the soluble gas is taken out through passage 42.

The present inventors conducted a test of processing molten steel containing a total amount of 80 ppm of oxygen by use of the present apparatus. The molten metal was continuously charged into a vessel through inlet 32 at a rate of 250 t/hr. The molten metal was bubbled by a mixed gas consisting of 60% Ar gas and 40% $H_2$ gas blown in from bubbling devices 44 and 46 at a rate of 200 l/min for 20 minutes. The molten metal containing a total amount of 12 ppm of oxygen was taken out in vacuum storage device at a rate of 250 t/hr through passage 42.

DESCRIPTION OF MORE PREFERRED EMBODIMENTS

Preferred Embodiment-3

Figure 10:
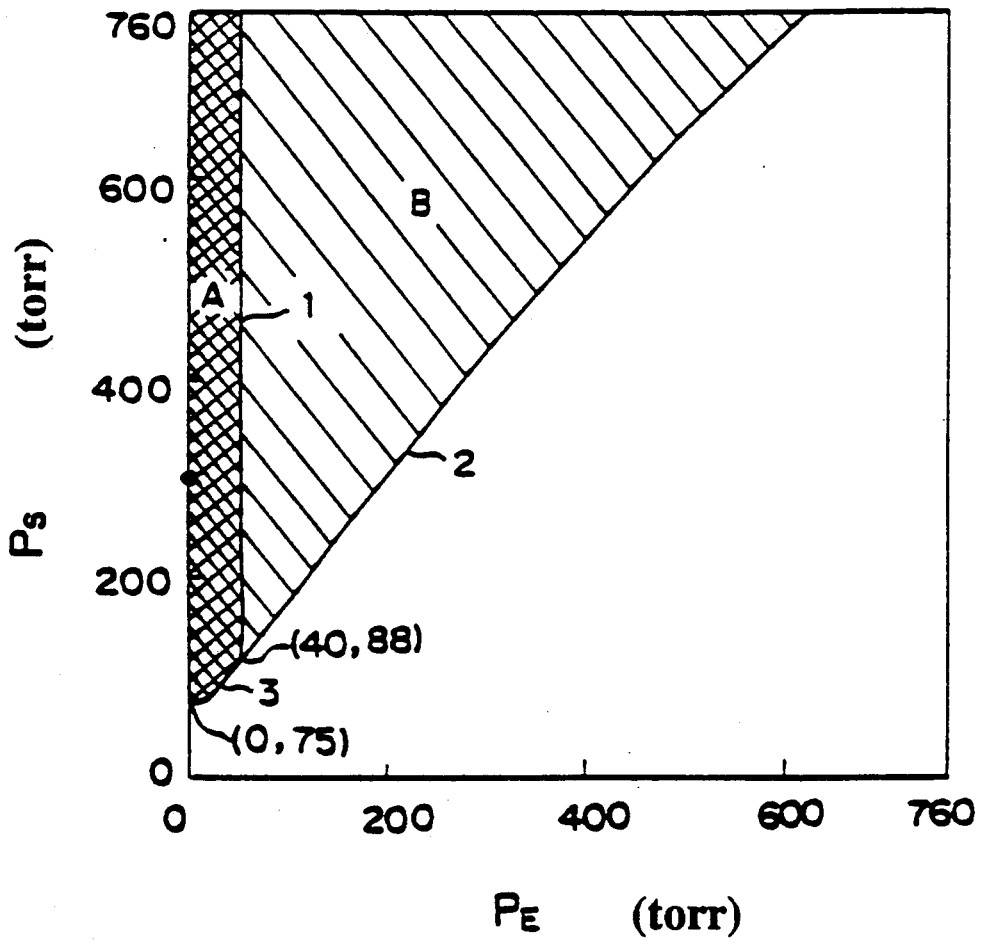
FIG. 10 is a graphical representation showing the relation between a pressure inside a vessel during bubbling of molten metal by blowing nitrogen gas into the molten metal and a pressure inside the vessel during degassing of the molten metal according to the present invention.

FIG. 10 shows a result of having studied the case when molten steel was used as molten metal and nitrogen as gas soluble in the molten steel. Namely, FIG. 10 is a graphical representation designating preferable zones out of coordinates of pressure Ps of atmosphere inside a vessel, under which the molten metal is bubbled by blowing said gas into the molten metal, and of reduced pressure $P_E$ of atmosphere inside the vessel. Units of Ps and $P_E$ are Torr. Zone B shown with oblique lines is a preferable zone. Zone A shown with crossing lines is more preferable zone. The zone B is a zone where the inclusions decrease. However, since the content of nitrogen [N] in the molten steel poses problems depending on steel species, a denitrification step is sometimes required after processing of the molten steel under reduced pressure.

In FIG. 10, a boundary 1 between the zones A and B, namely, $P_E=40$ Torr is determined in such a manner as described below. The relation betwen the pressure $P_N$ inside the gas tight vessel and the content of nitrogen [N] in the molten steel is determined by an equilibrium relation of the following equation (1) in the case of ordinary steel:

$$[N]=450\,(P_N)^{\frac{1}{2}} \qquad (1)$$

Units of [N] and $P_N$ are ppm and atm, respectively. The allowable largest value of [N] is estimated at 100 ppm. $[N]\leqq 100$ is obtained. $[N]\leqq 100$ is substituted for the equation (1) and the pressure unit is converted from atm to Torr, $P_N\leqq 38$ Torr is obtained. $P_E=40$ Torr is obtained by rounding $P_N\leqq 38$ Torr.

Line 2 passing the lower ends of the zone B is determined for the following reason:

The amount of nitrogen removed from the molten steel which was required for trapping the inclusions and making the inclusions rise to the surface of the molten steel needed to be 50 ppm or more by experience of the present inventors. The amount of removed nitrogen is the difference between $[N]_s$ and $[N]_E$. $[N]_s$ is the initial content of nitrogen increased by bubbling the molten steel by blowing nitrogen into the molten steel. $[N]_E$ is the final content of nitrogen decreased by degassing the molten steel under reduced pressure. That is to say, the line 2 is determined by the use of the following equation obtained by putting said equation (1) into $[N]s-[N]_E \geqq 50$ and representing pressures in Torr:

$$(Ps)^{\frac{1}{2}}-(P_E)^{\frac{1}{2}}=3.06 \quad (2)$$

The intersection point where the line 1 crossed the line 2 was (40, 88) in coordinates ($P_E$, Ps), $P_E=40$ being substituted for the equation (2). Further, in the case $P_E$ is less than 75 Torr in the equation (1), it takes much time to make an equilibrium state between the pressure $P_N$ and the content [N] and this is ineffective. $P_E$ of less than 75 Torr is considered difficult to apply. As a result, the line 3 passing the lower ends of the zone A was determined by connecting the point (0, 75) with the point (40, 88). More preferable zone A has two-dimensional rectangular coordinates, whose ordinate is Ps Torr and whose abscissa is $P_E$ Torr. The zone A is enclosed with Ps=760, $P_E=0$ and point (40, 88) and (0, 75) represented with ($P_E$, Ps). The preferable zone B has two-dimensional rectangular coordinates, whose ordinate is Ps Torr and whose abscissa is $P_E$. The zone B. is enclosed with Ps=760, $P_E=40$ and $(Ps)^{\frac{1}{2}}-(P_E)^{\frac{1}{2}}=3.06$. Within the zone B, a zone enclosed with Ps=760, $P_E=40$, $P_E=400$ and $(Ps)^{\frac{1}{2}}-(P_E)^{\frac{1}{2}}=3.06$ is more preferable in the two-dimensional rectangular coordinates, whose ordinate is Ps Torr and whose abscissa is $P_E$ Torr. Further, a zone enclosed with Ps=760, $P_E=40$, $P_E=200$ and $(Ps)^{\frac{1}{2}}-(P_E)^{\frac{1}{2}}=3.06$ is most desired.

EXAMPLE-6

Figure 11:
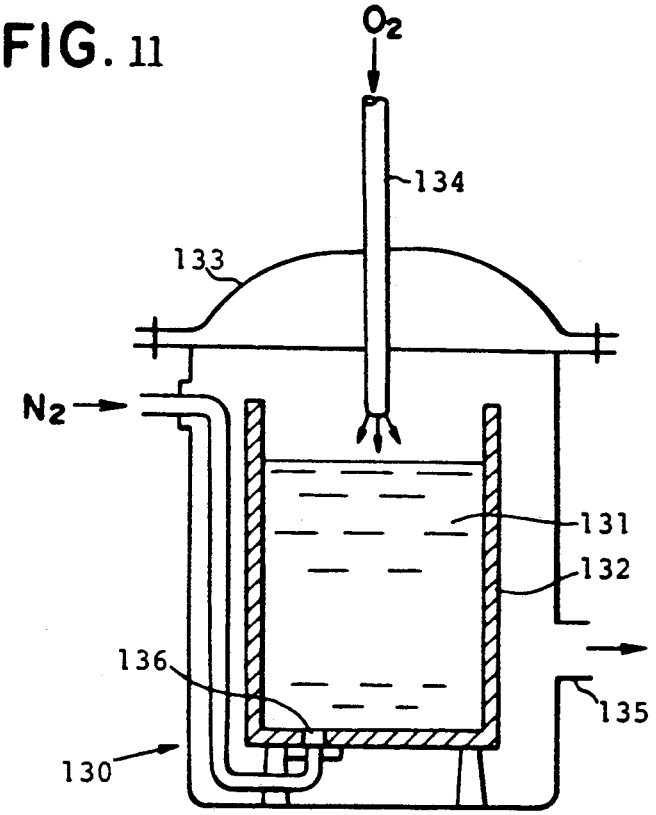
FIG. 11 is a vertical sectional view illustrating a refining apparatus for a ladle which carries out VOD processing according to the present invention.

An example of the present invention will be described with specific reference to the appended drawings. FIG. 11 is a vertical sectional view illustrating a refining apparatus for a ladle having been used for the example of the present invention. In the drawings, referential numeral 130 denotes a gas tight vessel. Ladle 132 of 50 ton capacity, into which molten steel 131 is charged, is put into the vessel. Cover 133 of the gas tight vessel 130 is arranged in a removal state. Lance 134 is fixed to the cover to be used for VOD (Vacuum Oxygen Decarbonization). Referential numeral 135 denotes an exhaust opening for making the gas tight vessel vacuum. Referential numeral 136 denotes a porous plug for blowing gas into the molten steel, which is arranged at the bottom of the ladle.

Figure 12:
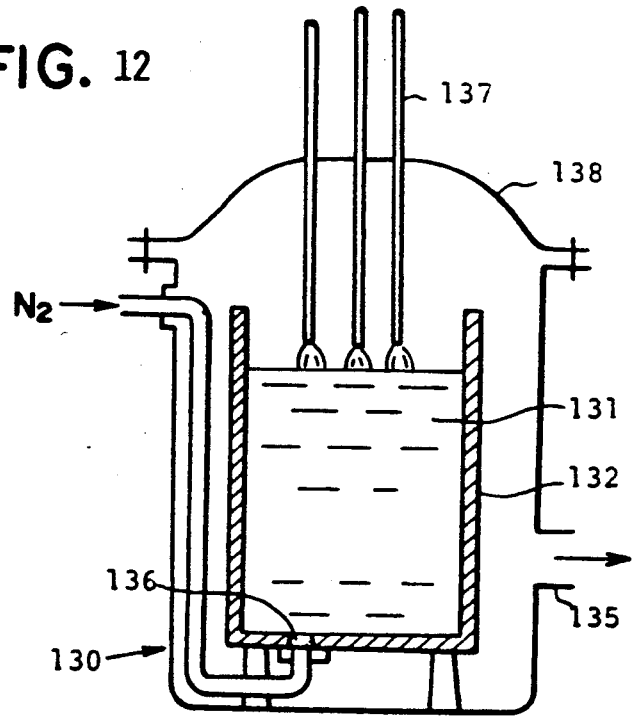
FIG. 12 is a vertical sectional view illustrating a refining apparatus for a ladle which carries out VAD processing according to the present invention.

50 t of molten steel charged into the ladle 132 was kept at 1660° C. and at 300 Torr in said gas tight vessel. 6 $Nm^3$ of $N_2$ was blown into the molten steel from the bottom of the ladle 132 for 10 min. Then, cover 133 was changed for another cover 138 having three electrodes as shown in FIG. 12 to carry out VAD (vacuum arc degassing). Pressure in the vessel was rapidly reduced to 1 Torr, a heat compensation being made for the molten steel by means of said electrodes 137, and the pressure of 1 Torr was kept for 20 min. At the same time, the molten steel was bubbled by Ar gas blown into the molten steel from the bottom of the ladle at 150N l/min. A black point shown in FIG. 10 corresponds to the Example-6.

The content of the molten steel obtained by processing of the molten steel in said Example-1 will be shown in Table 1. Example-7 shown in this Table will be described later. Results obtained in the case of using the prior art pressure elevation and reduction method (Control-1) wherein molten steel was degassed under reduced pressure after the molten steel had been bubbled by $N_2$ gas under elevated pressure of more than atmospheric pressure and an Ar gas bubbling method (Control-2) are shown as controls in Table 1. In the pressure elevation and reduction method, the pressure in the vessel was increased to 3 atm during blowing of $N_2$ gas and then reduced to 100 Torr during reduction of the pressure. As for other conditions the molten steel was processed under the same conditions as those of the example of the present invention. Ar gas, however, was not blown into the molten steel during pressure reduction.

In the Ar gas bubbling method, 50 t of molten steel was kept at 0.5 to 1 Torr in a vacuous ladle and bubbled by Ar gas blown into the molten steel from the bottom of the ladle at a rate of 150N l/min for 20 min.

TABLE 1

| | Time, (min) after Pressure Reduction | C % | Si % | Mn % | P % | S % | Sol Al % | T. [O] ppm | T. [N] ppm |
|---|---|---|---|---|---|---|---|---|---|
| Example-6 | 0 | 0.13 | 0.32 | 1.12 | 0.023 | 0.006 | 0.048 | 42 | 147 |
| | 10 | 0.13 | 0.31 | 1.12 | 0.023 | 0.006 | 0.047 | 8 | 38 |
| | 20 | 0.13 | 0.31 | 1.12 | 0.023 | 0.006 | 0.047 | 7 | 31 |
| Example-7 | 0 | 0.14 | 0.33 | 1.14 | 0.021 | 0.005 | 0.049 | 42 | 147 |
| | 10 | 0.14 | 0.32 | 1.13 | 0.021 | 0.005 | 0.047 | 7 | 60 |
| | 20 | 0.14 | 0.32 | 1.13 | 0.021 | 0.005 | 0.047 | 5 | 35 |
| Control-1 Pressure Elevation and Reduction Method | 0 | 0.13 | 0.33 | 1.13 | 0.020 | 0.005 | 0.050 | 41 | 632 |
| | 10 | 0.13 | 0.32 | 1.13 | 0.020 | 0.005 | 0.048 | 9 | 279 |
| | 20 | 0.13 | 0.32 | 1.13 | 0.020 | 0.005 | 0.047 | 9 | 162 |
| Control-2 Ar Gas Bubbling Method | 0 | 0.12 | 0.33 | 1.15 | 0.018 | 0.005 | 0.054 | 42 | 20 |
| | 10 | 0.12 | 0.32 | 1.14 | 0.018 | 0.005 | 0.054 | 24 | 19 |
| | 20 | 0.12 | 0.31 | 1.15 | 0.018 | 0.005 | 0.052 | 18 | 18 |

In Table 1, when Example-6 is compared with Control-1 or Control-2 relative to the total amount of oxygen T. [O] and the total amount of nitrogen T. [N] in the molten steel 20 min later after the pressure reduction, T. [O] in Example-6 decreased and T. [N] greatly decreased in comparison with the pressure elevation and reduction method. In comparison with the Ar gas bubbling method, it is recognized that T. [O] decreased. In this case, the amount of nitrogen increased slightly by blowing nitrogen gas, but such T. [N] does not pose any specific problem except for specific cases.

Preferred Embodiment-4

When the molten steel is stirred by blowing inert gas into the molten steel under reduced pressure as in the Example-1, soluble gas is remarkably removed from the molten steel and the amount of nitrogen decreased to the extent enough to be able to be put to practical use in spite of bubbling of the soluble gas in comparison with Control-1 and Control-2 in Table 1. The soluble gas, however, is removed during the pressure reduction and, at the same time, the occurrence of fine gas bubbles is also decreased. Accordingly, it is thought that the effect of rising and separation of nonmetallic inclusions decreases with the lapse of time. Therefore, it is intended in Example-2 to keep the effect of the rising and separation of the nonmetallic inclusions by blowing the soluble gas together with the inert gas during the pressure reduction.

EXAMPLE-7

An example of the present invention will be described specifically. As in Example-6 a refining apparatus for a ladle as shown in FIGS. 11 and 12 was used. Soluble gas was blown into molten steel before a pressure reduction, 50 t of molten steel being kept at 1660° C. and at 300 Torr. 6 $Nm^3$ of $N_2$ gas was blown from the bottom of the laddle as shown in FIG. 11 into the molten steel by means of a porous plug for 10 min. Then, cover 133 was changed for cover 138. Heat compensation was made for the molten steel by the use of arc heat of electrodes. The pressure in the ladle was rapidly reduced to 1 Torr and the pressure of 1 Torr was kept for 20 min. The molten steel was bubbled by blowing Ar gas as iner gas together with $N_2$ gas from the bottom of the ladle at a rate of 150N l/min. The flow of $N_2$ gas was decreased to zero in the last five minutes as shown in Table 2 so as to make the amount of soluble gas as small as possible.

TABLE 2

| | | Time after Pressure Reduction | | |
|---|---|---|---|---|
| | | 0~10 | 10~15 | 15~20 |
| Amount of Gas Blown into | Ar | 100 | 30 | 150 |
| Molten Steel Nl/min | $N_2$ | 50 | 120 | 0 |

The components of molten steel which were obtained as a result of having processed the molten steel in Example-7 will be shown in Table 1. When Example-7 is compared with Example-6 in this Table, it is recognized that T. [O] was decreased by blowing nitrogen into the molten steel under reduced pressure while T. [N] was increased slightly.

The soluble gas is removed by pressure reduction in Preferred Embodiment-3 and Preferred Embodiment-4. However, in case a depth of a molten metal bath is large, a static pressure in a bottom portion of the molten metal bath becomes large. In consequence, it becomes difficult to degass the molten steel by the use of only processing of molten steel under reduced pressure. Specifically, when the depth of the molten steel is 1.5 m or more, the above-mentioned tendency became remarkable. To degass the molten metal in the bottom portion of the molten metal bath of large depth, it is thought to turn a gas tight vessel having the molten metal therein upside down and to greatly stir said molten metal under reduced pressure. This example will be described according to Example-8 and Example-9 shown below with specific reference to FIGS. 13 to 17.

EXAMPLE-8

Figure 13:
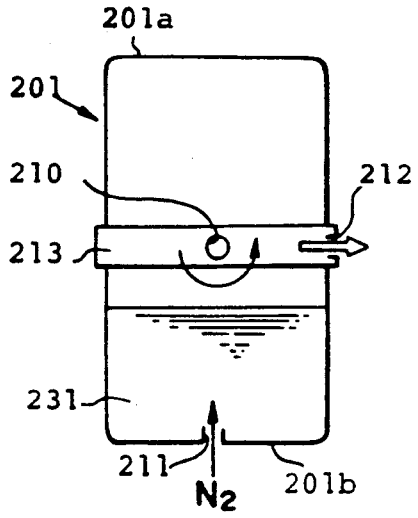
FIGS. 13 and 14 are plan views of a gas tight vessel having a horizontal rotation axis capable of rotating according to the present invention.

FIG. 13 shows an example of a gas tight vessel 201 being able to be turned upside down with the horizontal rotation axis in a central portion thereof. Said gas tight vessel 201 is made cylindrical by tightly jointing vessel 1*a* and vessel 1*b*, each of which has a form of a ladle of 2 m in diameter and 3 m in height. Gas blow opening 211 is positioned on an end face of the vessel 201*b*. Exhaust opening for exhausting an atmospheric gas from vessel 201 is arranged in joint portion 213 of the vessels 201*a* and 201*b*.

In this example, molten steel was cleaned by the use of the gas tight vessel 201 constituted with the vessels 201*a* and 1*b* as described above. 50 t of molten steel 231 was charged into the vessel 201*b*. Another vessel 201*a* was tightly jointed to the vessel 201*b* from above to form the vessel 201. Then, $N_2$ gas was blown into the vessel 201 through the gas blow opening 11 at a rate of 100 N l/min to bubble the molten steel 231 Gas was exhausted from the vessel 201 through said gas exhaust opening 212 so that the pressure inside the gas tight vessel 201 could not exceed a predetermined pressure. 20 minutes later, bubbling was stopped. In the above-mentioned state, the inside of the gas tight vessel 201 was made vacuous through said exhaust opening 212 with the use of a vacuum pump (not shown) so that the pressure inside the vessel 201 could be reduced to $10^{-2}$ Torr. When this degree of vacuum was kept, $N_2$ having dissolved in the molten steel 231 appeared as fine gas bubbles which trapped fine inclusions in the molten steel 231 and made the fine inclusions rise to the surface of the molten steel.

Figure 14:
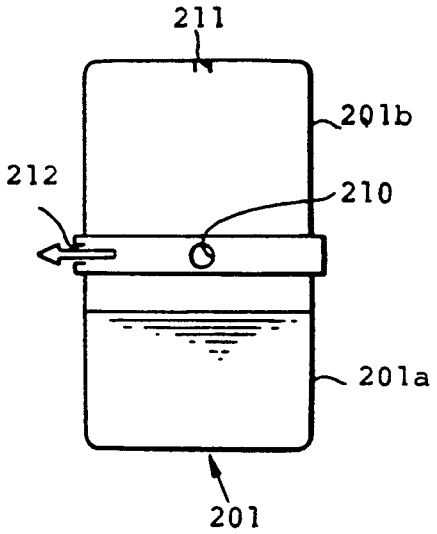

5 minutes later after this, the gas tight vessel was turned counterclockwise at 180° as shown in FIG. 14 and was made to be in the upsidedown state as shown in FIG. 13. Since a portion of the molten steel bath which had been in a deep position and had been under large static pressure was changed for a portion of molten steel bath of small depth, a static pressure decreased rapidly and a large amount of fine gas bubbles were produced from the portion of the molten steel bath of small depth. After the molten steel had been left in this state for 5 minutes, the gas tight vessel was turned clockwise at 180° to be again in the state of FIG. 13. In this case, the molten steel 231 was again stirred. Moreover, since the portion of the molten steel bath of large depth was changed for the portion of the molten steel bath of small depth, pressure on the portion of the molten steel bath having been under a large static pressure was rapidly reduced, $N_2$ gas having remained in the molten steel 231 appeared as fine gas bubbles. The molten steel was left in this state for 5 minutes. A vacuum pump was driven to keep the degree of vacuum at $10^{-2}$ Torr during the pressure reduction.

Figure 15:
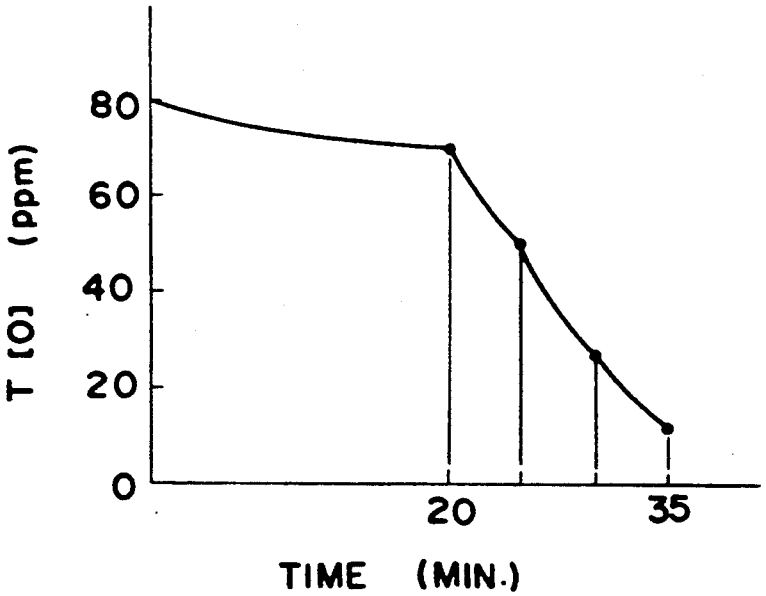
FIG. 15 is a graphical representation showing a change of the total amount of oxygen in the molten steel with the lapse of time according to the present invention.

FIG. 15 shows a change of the total amount of oxygen in the molten steel 231 with the lapse of time in the example. According to FIG. 15 the total amount of oxygen in the molten steel could be decreased from an initial 80 ppm to a final 12 ppm.

EXAMPLE-9

An apparatus used for this method was the apparatus having been used in Example-8 as shown in FIG. 13. As in Example-8, after molten steel had been kept in the gas tight vessel 201 and bubbled by blowing $N_2$ gas into the molten steel through gas blow opening 211 positioned in the bottom of the vessel 201, pressure inside the gas tight vessel was reduced to $10^{-2}$ Torr by evacuating the gas tight vessel and the vacuum was kept. After the degree of vacuum had been kept for 5 minutes, the gas tight vessel 201 was turned at 90° with central horizontal rotation axis 10 in a central portion thereof. The gas tight vessel 201 came to be in the state such that a longitudinal direction of the gas tight vessel of cylindrical shape was kept horizontally. Therefore, an area of bath of the molten steel 231 became large and a depth of the entire molten steel bath became small. As a result, a static pressure on a portion of the molten steel 231 which had been in a deep portion was reduced and fine gas bubbles began to be actively produced.

Figure 17:
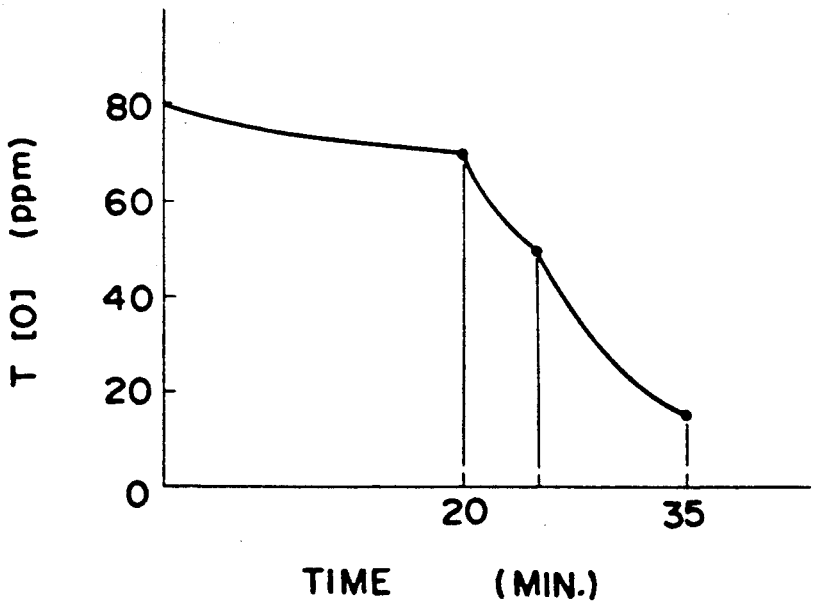
FIG. 17 is a graphical representation showing the total amount of oxygen in the molten steel in another example different from FIG. 15.

FIG. 17 is a graphical representation designating a change of the total amount of oxygen T. [O] in the molten steel 231 which was processed by the above-mentioned degassing method wherein the depth of the molten steel bath was made small. As shown in FIG. 17 it is understood that the degassing method is highly effective in processing of the molten steel since T. [O] in the molten steel was decreased from initial 80 ppm to final 15 ppm. In Example-8 wherein the gas tight vessel 201 was turned to 180°, when rotation of the gas tight vessel 201 was stopped for a while at the position where the vessel was turned to 90°, the effect of turning the gas tight vessel 201 at 180° and 90°. can be obtained.

EXAMPLE-10

Figure 18:
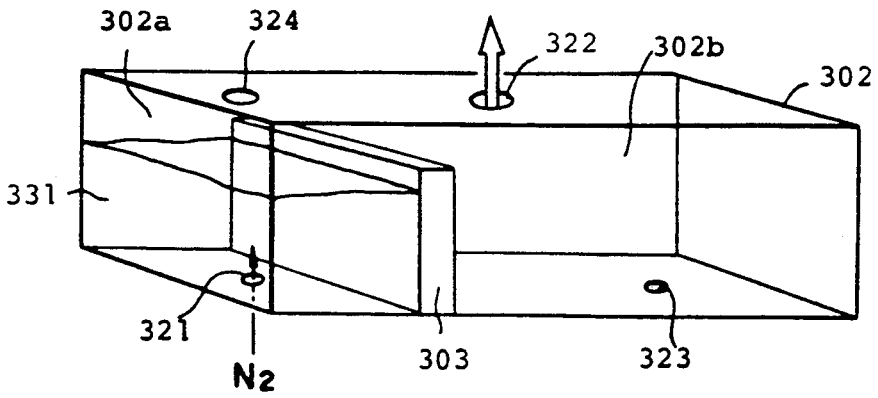
FIGS. 18 and 19 are perspective views designating a vessel of rectangular parallelepiped having a gate therein.

FIG. 18 is a schematic illustration showing another example of a method for promoting degassing of molten steel by making a depth of molten steel bath small. In this example, gas tight vessel 302 of parallelepiped of 3 min width, 3 min height and 8 m in length was used. Removable gate 303 of 3 m in length, 2.3 m in width and 0.5 m in thickness was arranged inside the gas tight vessel 302. The inside of the gas tight vessel 302 was divided into two chambers 302*a* and 302*b*. In the drawing, referential numeral 322 denotes an exhaust opening for exhausting inside atmosphere which is arranged in a ceiling of the gas tight vessel 302, 321 a gas injection opening arranged in the bottom of the chamber 302*a*, 323 an exit port for outflow of the molten steel which is arranged in the bottom of the chamber 302*b* and 324 an inlet for inflow of the molten steel which is arranged in a ceiling of the chamber 302*a*. Said gas injection opening 321 and said inlet for inflow of the molten steel are arranged so that they can be opened or closed if necessary.

Figure 19:
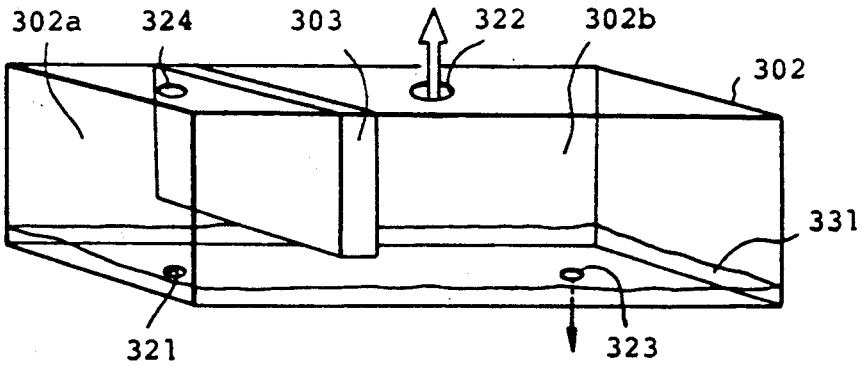

A method for cleaning molten steel by the use of the gas tight vessel 302 constituted in such a manner as described above will be described. In FIG. 18, gate 303 is positioned 2 m away from the left face of the gas tight vessel 302. Approximately 90 t of molten steel 331 is charged through the inlet 323 for inflow of the molten steel into one chamber 302*a* separated from the other chamber 302*b* by the gate 303. During charging of the molten steel, the exit port 323 for outflow of the molten steel is closed. The volume of the molten steel 331 comes to be 12 $m^3$ of 3 m in length, 2 m in width and 2 m in depth. $N_2$ gas is blown through the gas blow opening 321 at a rate of 100 N l/min and the molten steel 331 is bubbled by $N_2$ gas. During bubbling, the inside atmosphere is simultaneously exhausted through said gas exhaust opening 322 so that there cannot be any excessive pressure inside the gas tight vessel. The bubbling of the molten steel is stopped 20 minutes later and the inside of the gas tight vessel 302 is evacuated through said gas exhaust opening 322 by the use of a vacuum pump (not shown). An opening is made between the bottom face and the lower ends of the gate 303 by lifting the gate 303 upwardly as shown in FIG. 19 when the pressure inside the gas tight vessel 302 is reduced to $10^{-2}$ Torr. Then, the molten steel having been stemmed by said gate 303 spreads in the whole vessel 302. As a result, the depth of the molten steel 331 having been 2 m initially comes to be 0.5 m.

Since the depth of the molten steel becomes rapidly small and the area of the surface of the molten steel bath widens, fine gas bubbles are actively produced. When the molten steel 331 is discharged by opening the exit port 323 for outflow of the molten steel, approximately the total amount of the molten steel flowed out of the vessel 302 a quarter of an hour later.

It is clearly understood that the above-mentioned method is highly effective in cleaning of molten steel since the total amount of oxygen was decreased from initial 80 ppm to final 12 ppm as a result of having cleaned the molten steel in such a manner as described above.

A further method for refining molten steel in a vacuum of the present invention comprises an immersion process, wherein immersion tubes are immersed in molten steel, a dissolving process, wherein gases are dissolved in said molten steel, a first degassing process and a second degassing process.

Immersion Process

Two immersion nozzles arranged at the lower portion of vacuum vessel 404 are immersed in molten steel in a ladle. One of the two immersion nozzles is rising tube 405 and the other sinking tube 406.

Dissolving Process

Figure 20:
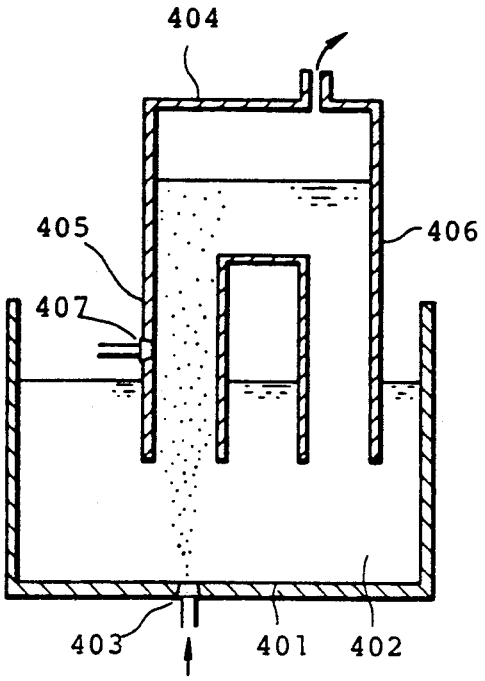
FIG. 20 is a sectional view schematically showing a dissolving process, wherein gases are dissolved in molten steel, according to the present invention.

FIG. 20 is a sectional view schematically showing a dissolving process, wherein gases are dissolved in molten steel, according to the present invention. Molten steel 402 inside ladle 401 is pressurized by its static pressure. Gases containing at least gas soluble in molten steel are blown in molten steel 402 through gas blow-in opening 403 arranged at the bottom of ladle 401. It is, of course, possible to blow a mixed gas consisting of gas soluble in said molten steel and an inert gas in said molten steel. Molten steel 402 is bubbled by said mixed gas. Together with bubbling of said molten steel, a large amount of gas soluble in said molten steel dissolves in said molten steel. Gases can be simultaneously blown in said molten steel through gas blow-in opening 407 arranged in rising tube 405 of vacuum vessel 404. The amount of gases dissolved in said molten steel is expected to be quickly increased. A part of inclusions in molten steel 402 is trapped by bubbled gas and rises to the surface of said molten steel. When said molten gas rises to the surface of said molten steel, a pressure to said molten steel is decreased. As a result, the gases having been dissolved in said molten steel convert to fine bubbles. Fine inclusions in said molten steel are trapped by produced gas bubbles and rise to the surface of said molten steel.

Hydrogen gas, nitrogen gas and hydrocarbon gas as gases soluble in the molten steel are used, they are provided by mixed gas blown in the molten steel. Ar gas and He gas are used as an inert gas. Only gases which are soluble in the molten steel can be used instead of the mixed gas. In this preferred Embodiment-5, gases were blown in the molten steel from gas blow-in opening 403 arranged at the bottom of ladle 1, but ways of a gas blow-in are not limited to this. Gases can be blown in the lower portion of the molten steel in ladle 401. Gas blow-in opening 403, however, is desired to be arranged in the bottom wall of ladle 401 just under rising tube. In this process, a large amount of gas can be blown in the molten steel with the use of an immersion lance before an immersion tube is immersed in the molten steel. Said immersion lance is immersed from the surface of the molten steel into the molten steel.

First Degassing Process

Figure 21:
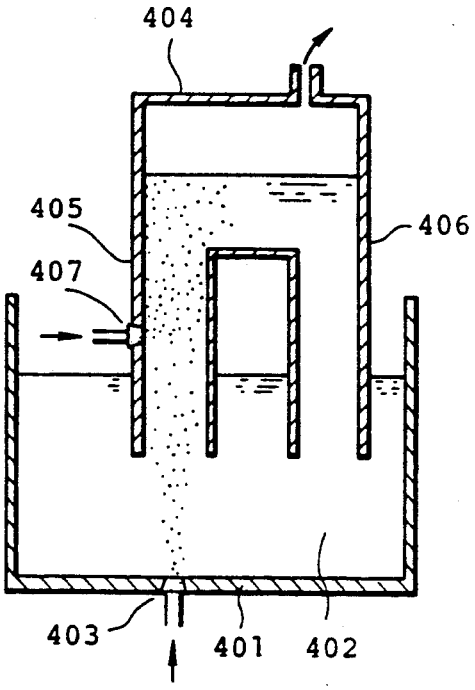
FIG. 21 is a sectional view schematically showing a first degassing process of the present invention.

FIG. 21 is a sectional view schematically showing a first degassing process of the present invention. Vacuum vessel 404 is kept evacuated. An inert gas is injected from gas blow-in opening 407 arranged in the middle of rising tube 405. Thereby, molten steel is made to circulate between ladle 401 and vacuum vessel 404. Gases including at least gas soluble in the molten steel are blown in molten steel 402 from gas blow-in opening 403 of ladle 401. Molten steel 402 is bubbled by the gases blown in. Together with bubbling, the gas soluble in the molten steel dissolves in the molten steel. On the other hand, since a pressure of the atmosphere inside the vacuum vessel is reduced to 2 to 3 Torr, the molten steel is degassed. With the rise of the molten steel toward the surface of the molten steel in vacuum vessel 404, the gas dissolved in the molten steel converts to bubbles. The gas components having been dissolved in the molten steel in the dissolving process and having not appeared near the surface of the molten steel also appear in the form of bubbles. Fine inclusions contained in the molten steel are trapped by the produced gas bubbles and rise to the surface of the molten steel in vacuum vessel 404. A part of the inclusions contained in molten steel 402 are trapped by bubbled inert gas and rises to the surface of the molten steel in vacuum vessel 404.

An inert gas was used in this preferred embodiment-5 as the gas which was injected from the gas blow-in opening arranged in the middle of rising tube 405. The gases to be used, however, are not limited to the inert gas. A mixed gas of an inert gas and gas soluble in the molten steel can be used. In case the mixed gas is used, fine inclusions are expected to be removed because the gas is dissolved in the molten steel and fine gas bubbles are produced under decreased pressure. Ar gas and He gas can be used as an inert gas. As in case of gas blow-in in the dissolving process, the gas blown in molten steel 402 from gas blow-in opening 403 of ladle 401 can be either a mixed gas consisting of gas soluble in the molten steel and an inert gas or only gas soluble in the molten steel.

Out of mixed gases blown in the molten steel, hydrogen gas, nitrogen gas and hydrocarbon gas used as the gas soluble in the molten steel. Ar gas and He gas are used as an inert gas. In this Preferred Embodiment, the gas was blown in the molten steel from gas blow-in opening 403 arranged at the bottom of ladle 401, but ways of gas blow-in are not confined to this example.

It is sufficient to blow the gas in the lower portion of the molten steel in ladle 401. It, however, is desirable to arrange gas blow-in opening 403 in the bottom wall of ladle 401 just under rising tube 405.

Second Degassing Process

Figure 22:
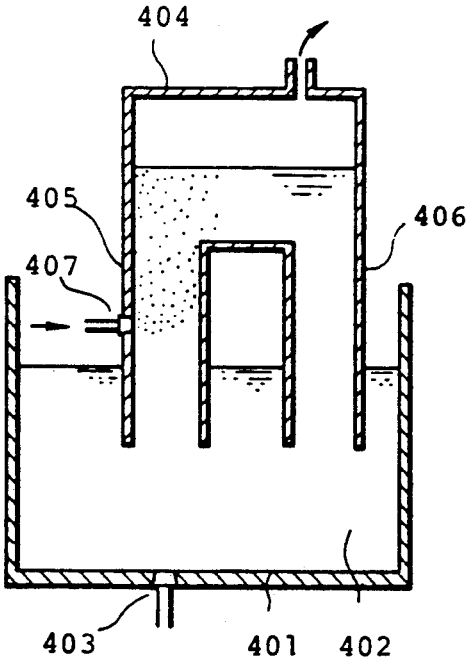
FIG. 22 is a sectional view schematically showing a second degassing process of the present invention.

FIG. 22 is a sectional view schematically showing a second degassing process of the present invention. Vacuum vessel 404 is kept evacuated. An inert gas is injected in vacuum vessel 404 from gas blow-in opening 407 arranged in the middle of rising tube 405 to make molten steel circulate between ladle 401 and vacuum vessel 404. Gas blow-in from gas blow-in opening 403 of ladle 401 is stopped. Since the atmospheric pressure in vacuum vessel 404 is decreased to 2 to 3 Torr, the molten steel is degassed. Gas components, which have been dissolved in the molten steel in the first degassing process and have not been able to be removed, are removed. In this preferred embodiment-5, an inert gas was used. However, dependent on the permissible range of the gas soluble in molten steel, the gases to be used are not confined to the inert gas. In case a permissible concentration of final gas components soluble in molten steel is high, a mixed gas of an inert gas and gas soluble in molten steel can be used.

The method for refining molten steel in a vacuum (a) comprising an immersion process, wherein immersion tubes are immersed in molten steel, a dissolving process, wherein gases are dissolved in said molten steel, a first degassing process and a second degassing process described above, but the method of the present invention is not limited to this combination of processes. Methods as mentioned below can be used.

(b) A method comprising an immersion process, wherein immersion tubes are immersed in molten steel, a first degassing process and a second degassing process.

(c) A method comprising an immersion process, wherein immersion tubes are immersed in molten steel, a dissolving process, wherein gases are dissolved in molten steel and a first degassing process.

(d) A method comprising an immersion process, wherein immersion tubes are immersed in molten steel and a first degassing process.

(e) A method comprising an immersion process, wherein immersion tubes are immersed in molten steel, a dissolving process, wherein gases are dissolved in molten steel and a second degassing process.

Differences in effects of the methods of from (a) to (e) during the use of $N_2$ gas as gas soluble in molten steel will be described. When molten steel is processed by use of the method (a), a total amount of oxygen in the molten steel is decreased to the lowest level among the total amounts of oxygen decreased by use of the methods of from (a) to (e). The amount of N in the molten steel becomes low when the second degassing process is carried out longer by use of the method (e). The methods (b) and (d) which do not comprise the dissolving process are useful because of a simplicity of the processes. The methods (b) and (d), however, are somewhat inferior to the methods (a), (c) and (e), which comprise the dissolving process, in the effects of removing oxygen in the molten steel. In the method (d), the amount of N in the molten steel increases, but the molten steel is easily processed. Therefore, selection of the methods as mentioned above varies dependent on species of steel to be used and equipment which is used.

EXAMPLE-11

Figure 23:
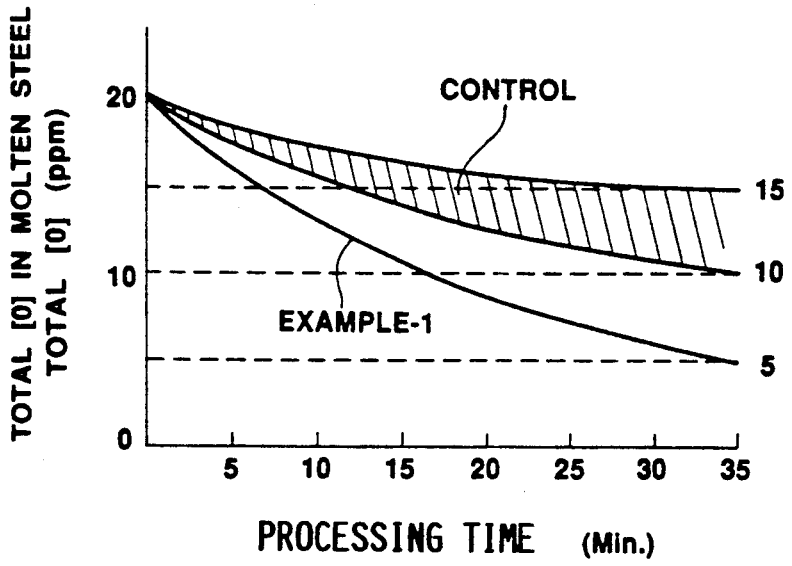
FIG. 23 is a graphical representation indicating the relation between a processing time in a vacuum refining and a total amount of oxygen in molten steel in Example-6 of the present invention.

250 tons of molten steel were processed with the use of the method (b). For first 20 minutes, a mixed gas consisting of 40% Ar gas and 60% $H_2$ gas was blown in said molten steel from gas blow-in opening 407 of rising tube 5 and from gas blow-in opening 403 of ladle 401 respectively at a rate of 180 $Nm^3/hr$ and at a rate of 60 $Nm^3/hr$. Thereafter, gas blowing-in from gas blow-in opening 403 of ladle 401 was stopped and, at the same time, 100% Ar gas was blown in the molten steel from gas blow-in opening 407 of rising tube 405 at a rate of 180 $Nm^3/hr$ for 15 minutes. A change of a total amount of oxygen in the molten steel relative to a processing time is indicated in FIG. 23. The total amount of oxygen in the molten steel decreased to 5 ppm in processing of the molten steel for 35 minutes. The amount of hydrogen in the molten steel after having been processed could be decreased to 2 ppm or less.

EXAMPLE-12

250 tons of molten steel were processed with the use of the method (c). Firstly, a top-blow lance was immersed in the molten steel in a ladle and $N_2$ gas was blown in the molten steel at a rate of 180 $Nm^3/hr$ for 30 minutes. Subsequently, immersion tubes were immersed in the molten steel. Vacuum vessel 404 was kept evacuated, and a mixed gas consisting of 60% Ar gas and 40% $N_2$ was blown through gas blow-in opening 407 of rising tube 405 and through gas blow-in opening 403 of ladle 401 respectively at 120 $Nm^3/hr$ and at 60 $Nm^3/hr$ for 35 minutes. The total amount of oxygen in the molten steel was decreased to approximately 5 ppm by 35 minutes processing of the molten steel. The amount of nitrogen in the molten steel after having been processed was decreased to approximately 90 ppm.

EXAMPLE-13

250 tons of molten steel were processed by use of the method (d). A mixed gas consisting of 40% Ar gas and 60% $H_2$ gas was blown in the molten steel through gas blow-in opening 407 of rising tube 405 and through gas blow-in opening 403 of ladle 401 respectively at 120 $Nm^3/hr$ and at 60 $Nm^3/hr$ for 35 minutes. The total amount of oxygen in the molten steel was decreased to approximately 8 ppm by 35 minutes processing of the molten steel. The amount of nitrogen in the molten steel after having been processed was decreased to approximately 80 ppm.

EXAMPLE-14

250 tons of molten steel were processed by use of the method (e). Firstly, a top-blow lance was immersed in the molten steel in a ladle and $N_2$ gas was blown in the molten steel at 180 $Nm^3/hr$ for 30 minutes. Subsequently, immersion nozzles were immersed in the molten steel. Vacuum vessel 404 was kept evacuated and Ar gas was blown through gas blow-in opening 407 of rising tube 405 at 120 $Nm^3/hr$ for 35 minutes. The total amount of oxygen in the molten steel was decreased to approximately 6 ppm by 35 minutes processing of the molten steel. The amount of nitrogen in the molten steel after having been processed was decreased to approximately 35 ppm.

EXAMPLE-15

250 tons of molten steel were processed by use of the method (b). For the first 20 minutes, a mixed gas consisting of 20% Ar gas and 80% $N_2$ gas was blown in the molten steel through gas blow-in opening 407 of rising tube 405 and $N_2$ gas through gas blow-in opening 403 of ladle 401 respectively at 120 $Nm^3/hr$ and at 60 $Nm^3/hr$. Then, blowing-in of $N_2$ gas through gas blow-in opening 403 of ladle 401 was stopped, and, at the same time, 100% Ar gas blown in the molten steel through gas blow-in opening 407 of rising tube 405 at 120 $Nm^3/hr$ for 15 minutes. The total amount of oxygen in the molten steel was decreased to approximately 6 ppm by 35 minutes processing of the molten steel. The amount of nitrogen in the molten steel was decreased to approximately 40 ppm.

EXAMPLE-16

250 tons of molten steel was processed by use of the method (a). Firstly, a top-blow lance was immersed in the molten steel in a ladle, and $N_2$ gas was blown in the molten steel at 180 $Nm^3/hr$ for half an hour. Then, immersion nozzles were immersed in the molten steel. Vacuum vessel 404 was kept evacuated. For the first 20 minutes, a mixed gas consisting of 20% Ar gas and 80% $N_2$ gas was blown in vacuum vessel 404 through gas blow-in opening 407 of rising tube 405 and $N_2$ gas through gas blow-in opening 403 of ladle 1 respectively at 120 $Nm^3/hr$ and at 60 $Nm^3/hr$. Thereafter, blowing-in of $N_2$ gas through gas blow-in opening of ladle 401 was stopped, and at the same time, 100% Ar gas was blown through gas blow-in opening 407 of rising tube 405 at 120 $Nm^3/hr$ for 15 minutes. The total amount of oxygen in the molten steel was decreased to approximately 4 ppm by 35 minutes processing of the molten steel. The amount of nitrogen was decreased to approximately 50 ppm.

Figure 16:
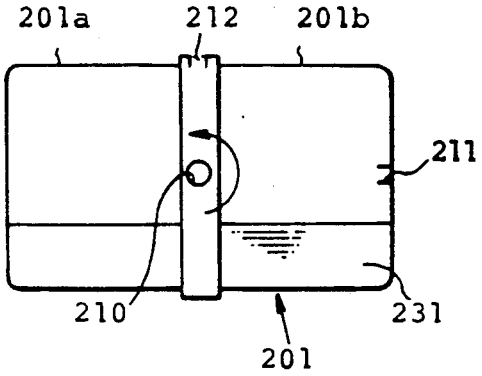
FIG. 16 is an plan view designating another example of the present invention wherein the same apparatus as in FIG. 13 is used.

Control 250 tons of molten steel were processed by use of a prior art RH vacuum degassing method. Two immersion tubes were immersed in the molten steel in ladle 401. The two immersion tubes were rising tube 405 and sinking tube 6. Vacuum vessel 404 was kept evacuated. Ar gas was blown in said vacuum vessel 404 from gas blow-in opening 407 arranged in the middle of rising tube 405 at a rate of 180 $Nm^3/hr$. The amount of the molten steel circulating in vacuum vessel 404 was 100 tons/min. The molten steel was processed for 35 minutes. A change of a total amount of oxygen in the molten steel relative to a processing time is indicated in FIG. 16. The total amount of oxygen in the molten steel decreased to approximately 10 ppm in processing of the molten steel for 35 minutes.

We claim:

1. A method for cleaning molten metal comprising the steps of:

applying a pressure of 1 to 10 atmospheres to molten metal which contains inclusions suspended therein in a vessel;

bubbling a gas which is soluble in the molten metal into the pressurized molten metal whereby (i) a portion of the inclusions suspended in the molten metal are trapped by gas bubbles produced by the bubbling gas and rise to a surface of the molten metal, and (ii) a portion of the bubbling gas is gas dissolved in the molten metal;

reducing the pressure on the molten metal whereby fine gas bubbles form in the molten metal and remaining inclusions suspending in the molten metal are trapped by the fine gas bubbles which rise to the surface of said molten metal; and removing the inclusions from the surface of the molten metal.

2. The method of claim 1, wherein said gas which is soluble in molten metal is nitrogen gas.

3. The method of claim 1, wherein said gas which is soluble in molten metal is hydrogen gas.

4. The method of claim 1, wherein the pressure on the molten metal is reduced in a plurality of successively lower pressure stages.

5. The method of claim 1, which comprises the additional step of applying a static magnetic field to the surface of the molten metal to suppress fluttering of the molten metal when the inclusions trapped by the gas bubbles produced by bubbling the gas through the molten metal are rising to the surface.

6. The method of claim 1, which comprises the additional step of applying a static magnetic field to the surface of the molten metal to suppress fluttering of the molten metal when said remaining inclusions trapped by said fine gas bubbles are rising to the surface.

7. The method of claim 5, wherein the static magnetic field is one having a magnetic flux of 1000 to 5000 gausses.

8. The method of claim 6, wherein the static field is one having a magnetic flux of 1000 to 5000 gausses.

9. The method of claim 1, which further comprises the additional step of stirring the molten metal by a low frequency electromagnetic force during the bubbling operation.

10. The method of claim 1, which further comprises the additional step of stirring the molten metal by a high frequency electromagnetic force during the bubbling operation.

11. The method of claim 1, which further comprises the additional step of degassing the molten metal in vacuum during the operation of reducing the pressure.

12. The method of claim 1, wherein 3 to 10 atmospheres pressure is applied to the molten metal.

13. The method of claim 2, wherein 3 to 10 atmospheres pressure is applied to said molten metal and when the pressure on the molten metal is reduced, it is reduced in a plurality of successively lower pressure stages.

14. The method of claim 3, wherein 3 to 10 atmospheres pressure is applied to said molten metal and when the pressure on the molten metal is reduced, it is reduced in a plurality of successively lower pressure stages.

15. The method of claim 14, which comprises the step of applying a static magnetic field having a magnetic flux of 1000 to 5000 gausses to the surface of the molten metal to suppress fluttering of the molten metal when the inclusions trapped by the gas bubbles produced by bubbling the gas through the molten metal are rising to the surface; and applying a static magnetic field having a magnetic flux of 1000 to 5000 gausses to the surface of the molten metal to suppress fluttering of the molten metal when the remaining inclusions trapped by said fine gas bubbles are rising to the surface.

16. The method of claim 14, wherein the molten metal is stirred by an electromagnetic force while said gas is being bubbled into the pressurized molten metal.

17. An apparatus for cleaning molten metal comprising:

a first vessel having an inlet for charging molten metal at the upper portion of the first vessel and an outlet for discharging the molten metal at the bottom of the first vessel, wherein the molten metal is pressurized by its own static weight;

a second vessel having an inlet port for receiving the pressurized molten metal from the first vessel, at the bottom of the second vessel and an outlet port for the molten metal disposed higher than said inlet port, whereby the pressurized molten metal is reduced in pressure when the pressurized molten steel comes up from the inlet port to the outlet port;

a communicating tube connecting the outlet of the first vessel and the inlet port of the second vessel;

a first bubbling device, for bubbling a gas which is soluble in molten metal, disposed at the bottom of the first vessel; and a second bubbling device for bubbling a gas which is soluble in molten metal, said second bubbling device being disposed in said communicating tube.

18. The apparatus of claim 17, which further comprises a vacuum storage chamber next to the outlet port of the second vessel.

19. The apparatus of claim 17, which further comprises a gas storage vessel for discharging a part of the gas bubbled by the bubbling device.

20. The apparatus of claim 17, wherein the first vessel has electromagnetic coils for stirring the molten metal in the first vessel.

21. A method for refining molten steel in a vacuum comprising:

an immersion process, wherein two downwardly extending spaced apart immersion tubes positioned at a lower portion of a vacuum vessel, are immersed in molten steel in a ladle, said two immersion tubes being a rising tube and a sinking tube;

a degassing process, wherein said molten steel is degassed by keeping said vacuum vessel evacuated, circulating said molten steel between said ladle and said vacuum vessel through said tubes by injecting a gas containing at least an inert gas from an intermediate portion of said rising tube and blowing into said molten steel in the ladle a gas containing at least a gas which is soluble in said molten steel.

22. The method of claim 21, wherein said gas containing at least a gas which is soluble in said molten steel comprises a mixed gas of gas soluble in said molten steel and an inert gas.

23. The method of claim 22, wherein said gas containing at least a gas which is soluble in said molten steel is selected from the group consisting of hydrogen gas, nitrogen gas and a hydrocarbon gas.

24. The method of claim 21, wherein said gas containing at least a gas which is soluble in said molten steel is selected from the group consisting of hydrogen gas, nitrogen gas and a hydrocarbon gas.

25. The method of claim 21, wherein said gas containing at least a gas which is soluble in said molten steel is blown in through a gas blow-in opening in said ladle.

26. The method of claim 25, wherein s gas blow-in opening in said ladle comprises a gas blow-in opening positioned under said rising tube.

27. The method of claim 21, wherein said gas containing at least a gas which is soluble in said molten steel is blown in through a top-blow lance which is immersed in said molten steel.

28. The method of claim 21, wherein said gas containing at least an inert gas comprises a mixed gas of the inert gas and gas soluble in said molten steel.

29. The method of claim 21, wherein said gas containing at least an inert gas comprises at least one of Ar gas and He gas.

30. The method of claim 21, which further comprises a dissolving process, wherein a gas containing at least a gas soluble in said molten steel is dissolved in said molten steel by blowing said gas into said molten steel before said degassing process.

31. The method of claim 30, wherein said gas containing at least a gas which is soluble in said molten steel comprises a mixed gas of a gas which is soluble in said molten steel and an inert gas.

32. The method of claim 30, wherein gas soluble in said molten steel comprises one selected from the group consisting of hydrogen gas, nitrogen gas and a hydrocarbon gas.

33. The method of claim 30, wherein said gas containing at least a gas which is soluble in said molten steel comprises one selected from the group consisting of hydrogen gas, nitrogen gas and a hydrocarbon gas.

34. The method of claim 30, wherein said gas containing at least a gas which is soluble in said molten steel is blown in through a gas blow-in opening in said ladle.

35. The method of claim 34, wherein said gas blow-in opening in said ladle comprises a gas blow-in opening positioned under said rising tube.

36. The method of claim 30, wherein said gas containing at least a gas which is soluble in said molten steel is blown in through a top-blow lance which is immersed in said molten steel.

37. The method of claim 21, which further comprises a second degassing process, wherein said molten steel is further degassed by keeping said vacuum vessel evacuated, stopping a gas blowing-in from said gas blow-in opening in said ladle and continuing to circulate said molten steel between said ladle and said vacuum vessel by injecting a gas containing at least an inert gas from a middle portion of said rising tube to circulate said molten steel between said ladle and said vacuum vessel.

38. The method of claim 37, wherein said gas containing at least an inert gas comprises a mixed gas of an inert gas and a gas which is soluble in said molten steel.

39. The method of claim 38, wherein said gas containing at least an inert gas comprising at least one of Ar gas and He gas.

40. A method for refining molten steel in a vacuum comprising:

an immersion process, wherein two downwardly extending spaced apart immersion tubes are positioned at a lower portion of a vacuum vessel are immersed in molten steel in a ladle, said two immersion nozzles being a rising tube and a sinking tube;

a dissolving process, wherein gases are dissolved in said molten steel by blowing into said molten steel a gas containing at least a gas which is soluble in said molten steel from a gas blow-in opening in said ladle;

a degassing process, wherein said molten steel is degassed by keeping said vacuum vessel evacuated, circulating said molten steel between said ladle and said vacuum vessel through said tubes by injecting a gas containing at least an inert gas from an intermediate portion of said rising tube into said molten steel and blowing a gas containing at least a gas which is soluble in said molten steel from a gas blow-in opening in said ladle.

41. A method for refining molten steel in a vacuum comprising:

an immersion process, wherein two downwardly extending spaced apart immersion tubes are positioned at a lower portion of a vacuum vessel are immersed in molten steel in a ladle, said two immersion nozzles being a rising tube and a sinking tube;

a dissolving process, wherein gases are dissolved in said molten steel by blowing into said molten steel a gas containing at least a gas which is soluble in said molten steel from a gas blow-in opening in said ladle;

a first degassing process, wherein said molten steel is degassed by keeping said vacuum vessel evacuated, circulating said molten steel between said ladle and said vacuum vessel through said tubes by injecting a gas containing at least an inert gas from an intermediate portion of said rising tube into said molten steel and blowing a gas containing at least a gas which is soluble in said molten steel from a gas blow-in opening in said ladle; and a second degassing process, wherein said molten steel is degassed by keeping said vacuum vessel evacuated, stopping a gas blowing-in from said gas blow-in opening in said ladle and circulating said molten steel between said ladle and said vacuum vessel through said tubes by injecting a gas containing at least an inert gas from a middle portion of said rising tube into said molten steel.

42. A method for refining molten steel in a vacuum comprising:

an immersion process, wherein two downwardly extending spaced apart immersion tubes are positioned at a lower portion of a vacuum vessel are immersed in molten steel in a ladle, said two immersion nozzles being a rising tube and a sinking tube;

a dissolving process, wherein gases are dissolved in said molten steel by blowing into said molten steel a gas containing at least a gas which is soluble in said molten steel from a gas blow-in opening in said ladle; and a degassing process, wherein said molten steel is degassed by keeping said vacuum vessel evacuated, stopping said gas blowing-in from said gas blow-in opening in said ladle and circulating said molten steel between said ladle and said vacuum vessel through said tubes by injecting a gas containing at least an inert gas from an intermediate portion of said rising tube into said molten steel.

43. A method for cleaning molten metal comprising the steps of:

keeping a pressure inside a vessel having molten metal therein at a pressure of Ps of atmospheric pressure or less;

bubbling the molten metal in the vessel by gas soluble in the molten metal, a portion of said gas dissolving in the molten metal and the rest of said gas converting to gas bubbles;

after bubbling said gas through said molten metal for at least five minutes, producing in the molten metal in the vessel, by pressure reduction to a pressure $P_E$ in said vessel, gas bubbles of a smaller size than the bubbles into which said gas is converted by the bubbling step and thereby trapping nonmetallic inclusions by said smaller size gas bubbles and raising them to the surface of the molten metal;

stopping the bubbling of said gas, and continuing the maintenance of reduced pressure for at least five minutes after the end of bubbling and thereby removing gas dissolved in the molten metal.

44. The method of claim 43, wherein said pressure Ps in the step of keeping a pressure and said pressure $P_E$ in said pressure reduction are pressures Ps and $P_E$ of atmosphere inside the vessel in a zone enclosed with $Ps=760$, $P_E=40$ and $(Ps)^{\frac{1}{2}}-(P_E)^{\frac{1}{2}}=3.06$ in two-dimensional rectangular coordinates, whose ordinate is Ps Torr and whose abscissa is $P_E$ Torr.

45. The method of claim 44, wherein said pressure Ps and said pressure $P_E$ are pressures Ps and $P_E$ of atmosphere inside the vessel in a zone enclosed with $Ps=760$, $P_E=40$, $P_E=400$ and $(Ps)^{\frac{1}{2}}-(P_E)^{\frac{1}{2}}=3.06$ in the two-dimensional rectangular coordinates, whose ordinate is Ps Torr and whose abscissa is $P_E$ Torr.

46. The method of claim 45, wherein said pressure Ps and said pressure $P_E$ are pressures Ps and $P_E$ of atmosphere inside the vessel in a zone enclosed with $Ps=760$, $PE=40$, $P_E=200$ and $(Ps)^{\frac{1}{2}}-(P_E)^{\frac{1}{2}}=3.06$ in the two-dimensional rectangular coordinates, whose ordinate is Ps Torr and whose abscissa is $P_E$ Torr.

47. The method of claim 43, wherein the pressure Ps in the step of keeping a pressure and the pressure $P_E$ in the step of reducing the pressure are pressures Ps and $P_E$ of atmosphere inside the vessel in a zone enclosed with $Ps=760$, $P_E=40$, $P_E=0$ and a line connecting points (40,88) and (0,75) represented with coordinates ($P_E$, Ps) in the two-dimensional rectangular coordinates, whose ordinate is Ps Torr and whose abscissa is $P_E$ Torr.

48. The method of claim 43, wherein said gas soluble in the molten metal in the step of bubbling is $N_2$.

49. The method of claim 43, wherein said step of producing smaller size bubbles by pressure reduction includes stirring said molten metal by blowing inert gas into molten metal.

50. The method of claim 49, wherein said gas soluble in the molten metal is continued to be blown in the molten metal during the blowing of inert gas into the molten metal until not less than five minutes before the end of the blowing-in of said inert gas.

51. The method of claim 43, wherein bubbling is stopped before said pressure reduction and wherein said vessel is gas tight and turnable as a whole as well as connected for evacuation and for blowing gas in and wherein said step of producing smaller-size bubbles by pressure reduction is aided by turning said vessel having the molten metal therein in such a way that molten metal is caused to shift from a deep molten metal bath configuration favorable for bubbling over to a shallower metal bath configuration favorable for degassing.

52. The method of claim 43, wherein said vessel is gas-tight as well as connected for blowing gas in and for evacuation and has means for decreasing the bath depth of molten metal by permitting lateral extension of the molten metal bath within said vessel and wherein said step of producing smaller-size bubbles by pressure reduction is aided by decreasing said depth of the molten metal bath held in the gas tight vessel.

53. A method of cleaning molten metal according to claim 44, comprising the steps of:

maintaining the pressure inside a gas tight vessel having molten metal therein and equipped for evacuation and for blowing of a bubbling gas into it, at a pressure not greater than atmospheric pressure and not less than 200 Torr;

bubbling the molten metal in the vessel for at least five minutes by gas soluble in the molten metal, a portion of said gas dissolving in the molten metal and the rest of said gas converting to gas bubbles, then reducing said pressure inside said vessel to a pressure below 10 Torr while supplying heat for compensation of cooling produced by gas expansion and, after pressure reduction, maintaining the reduced pressure while bubbling an inert gas through said molten metal for at least ten minutes.

54. The method of claim 53, wherein said gas soluble in the molten metal is mixed with said inert gas and bubbled therewith through said molten metal until not less than five minutes before the end of the bubbling of said inert gas through said molten metal.

55. The method of claim 53, wherein the supply of said gas soluble in the molten metal applied for bubbling through said molten metal is reduced to zero not later than the beginning of bubbling with said inert gas.

56. The method of claim 53, wherein said molten metal is a ferrous metal, said gas soluble in the molten metal is nitrogen and said inert gas is argone.

57. A method for cleaning molten steel according to claim 52, in a gas tight vessel equipped for evacuation and for blowing-in gas through said molten metal, comprising the steps of:

keeping the pressure inside said vessel, having molten steel therein, at a pressure below atmospheric pressure and not less than 200 Torr;

bubbling the molten steel in said vessel with a gas soluble in the molten steel, a portion of said gas dissolving in the molten steel and the rest of said gas converting to gas bubbles, said bubbling being carried on for at least 10 minutes;

after the stopping of bubbling, reducing the pressure in said vessel to approximately $10^{-2}$ Torr and maintaining said reduced pressure, and during maintenance of said reduced pressure turning said vessel on itself from time to time to reduce static pressure in portions of the molten steel in said vessel.

58. A method for cleaning molten metal according to claim 52, in a gas tight vessel connected for evacuation and for bubbling gas through molten metal contained in the vessel and having means for introducing molten metal in a confined portion within the interior of said vessel and for controllably removing a restraint confining the molten metal to said confined portion of the interior of said vessel, said method comprising the steps of:

keeping the pressure inside said vessel, while molten metal is kept said confined portion thereof, at a pressure below atmospheric pressure and not less than 200 Torr while bubbling a gas soluble in the molten metal therethrough for at least 10 minutes;

after stopping the bubbling through said molten metal, evacuating said vessel to a pressure of approximately $10^{-2}$ Torr;

then actuating said means for moving the restraint confining said molten metal to said confined portion of the interior of said vessel, whereby the depth of the molten metal in said vessel is reduced and small gas bubbles are generated therein, and maintaining pressure in said vessel at said reduced pressure for a time sufficient for degassing said molten metal.

59. The apparatus of claim 18, which further comprises a gas storage vessel for discharging a part of the gas bubbled by the first and second bubbling devices and wherein the first vessel has an electromagnetic coil for stirring molten metal in the first vessel.

* * * * *

UNITED STATES PATENT AND TRADEMARK OFFICE

CERTIFICATE OF CORRECTION

PATENT NO. : 5,091,000

DATED : February 25, 1992

INVENTOR(S) : ISHII et al

It is certified that error appears in the above-identified patent and that said Letters Patent is hereby corrected as shown below:

Title page, Section [30] Foreign Application Priority Data, line 6, delete "October 6, 1988", and insert --January 21, 1988--.

Column 27, line 50 (claim 53), delete "44", and insert --43--.

Column 28, line 16 (claim 57), delete "52", and insert --51--.

Signed and Sealed this

Thirtieth Day of August, 1994

*Attest:*

Bruce Lehman

BRUCE LEHMAN

*Attesting Officer*

*Commissioner of Patents and Trademarks*